US010289067B2

(12) United States Patent
Enomoto et al.

(10) Patent No.: US 10,289,067 B2
(45) Date of Patent: May 14, 2019

(54) IMAGE FORMING APPARATUS

(71) Applicants: Tadayasu Enomoto, Kanagawa (JP); Shintaroh Yamada, Kanagawa (JP)

(72) Inventors: Tadayasu Enomoto, Kanagawa (JP); Shintaroh Yamada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 35 days.

(21) Appl. No.: 15/158,216

(22) Filed: May 18, 2016

(65) Prior Publication Data

US 2016/0363907 A1 Dec. 15, 2016

(30) Foreign Application Priority Data

Jun. 9, 2015 (JP) ..... 2015-116799
Sep. 30, 2015 (JP) ..... 2015-194561

(51) Int. Cl.
*B65H 27/00* (2006.01)
*G03G 21/20* (2006.01)
(Continued)

(52) U.S. Cl.
CPC ..... *G03G 21/203* (2013.01); *B65H 29/125* (2013.01); *G03G 15/6552* (2013.01);
(Continued)

(58) Field of Classification Search
CPC ..... G03G 9/00; G03G 13/20; G03G 13/23; G03G 15/6576; G03G 15/6579;
(Continued)

(56) References Cited

U.S. PATENT DOCUMENTS 5,132,742 A * 7/1992 Goto ..... G03G 15/234 271/291
6,381,442 B1 * 4/2002 Okitsu ..... G03G 15/6541 270/58.08

(Continued)

FOREIGN PATENT DOCUMENTS

JP 6-202506 7/1994
JP 9-188456 7/1997

(Continued)

*Primary Examiner* — Matthew G Marini
*Assistant Examiner* — Marissa Ferguson-Samreth
(74) *Attorney, Agent, or Firm* — Harness, Dickey & Pierce, P.L.C.

(57) ABSTRACT

An image forming apparatus includes an image forming unit to form an image on a sheet, a sheet ejection section to which a relay unit and a sheet processing apparatus are removably coupled, a driving-side ejection roller disposed in the sheet ejection section, to eject the sheet outside the apparatus, a plurality of driven-side ejection rollers that are replaceable, one of which is disposed facing the driving-side ejection roller, and a roller holder removably secured to the sheet ejection section to hold the one of the plurality of driven-side ejection rollers. Each driven-side ejection roller has a shaft and a plurality of roller bodies attached to the shaft and lined in an axial direction of the shaft. The driven-side ejection roller is replaced with another driven-side ejection roller in accordance with whether or not the relay unit and the sheet processing apparatus are coupled to the sheet ejection section.

25 Claims, 31 Drawing Sheets

(51) Int. Cl.
*G03G 15/00* (2006.01)
*B65H 29/12* (2006.01)

(52) U.S. Cl.
CPC ..... *G03G 15/6576* (2013.01); *B65H 2301/16* (2013.01); *B65H 2301/5122* (2013.01); *B65H 2404/1431* (2013.01); *B65H 2601/324* (2013.01); *G03G 2215/00776* (2013.01)

(58) Field of Classification Search
CPC ..... G03G 15/6552; G03G 21/203; G03G 2215/00776; B65H 31/26; B65H 2408/114; B65H 2801/24; B65H 2801/27; B65H 29/125; B65H 2301/16; B65H 2404/1431; B65H 2601/324
See application file for complete search history.

(56) References Cited

U.S. PATENT DOCUMENTS 9,454,122 B1* 9/2016 Dobashi ..... G03G 15/6582
9,676,582 B2* 6/2017 Wakabayashi ..... B65H 29/60
2002/0150403 A1* 10/2002 Katsuyama ..... H04N 1/00525 399/107
2006/0008283 A1 1/2006 Oohara et al.
2006/0097445 A1* 5/2006 Fukatsu ..... B65H 31/26 271/220
2007/0235924 A1* 10/2007 Kimura ..... B65H 1/00 271/265.01
2009/0295897 A1* 12/2009 Komuro ..... B41J 3/4071 347/104
2011/0215516 A1* 9/2011 Sugizaki ..... B65H 31/00 271/3.18
2013/0026695 A1* 1/2013 Tokuma ..... B65H 31/34 270/58.07
2013/0038663 A1 2/2013 Obata et al.
2013/0334759 A1* 12/2013 Osaki ..... B65H 29/00 271/3.14
2014/0368848 A1* 12/2014 Takata ..... B65H 29/60 358/1.12
2015/0048568 A1* 2/2015 Yoshikawa ..... B65H 29/14 271/314
2015/0191324 A1* 7/2015 Fumoto ..... B65H 9/002 271/3.2
2015/0298931 A1* 10/2015 Osaki ..... B65H 43/00 271/265.01
2016/0318731 A1* 11/2016 Kowase ..... B65H 43/04
2016/0334751 A1* 11/2016 Kowase ..... B65H 29/125

FOREIGN PATENT DOCUMENTS

JP 2000-247526 9/2000
JP 2001-048392 2/2001
JP 2006-023427 1/2006
JP 2007183391 * 7/2007 ..... G03G 21/20
JP 2007-276934 10/2007
JP 2007-331845 12/2007
JP 2009-166944 7/2009
JP 2010-076925 4/2010
JP 2013-043715 3/2013
JP 2013-103390 5/2013
JP 2014-092706 5/2014

* cited by examiner

IMAGE FORMING APPARATUS

CROSS-REFERENCE TO RELATED APPLICATIONS

This patent application is based on and claims priority pursuant to 35 U.S.C. § 119(a) to Japanese Patent Application No. 2015-116799 filed on Jun. 9, 2015 and 2015-194561 filed on Sep. 30, 2015, in the Japan Patent Office, the entire disclosure of each of which is hereby incorporated by reference herein.

BACKGROUND

Technical Field

Embodiments of the present invention generally relate to an image forming apparatus, such as a copier, a printer, a facsimile machine, or a multifunction peripheral (MFP) having at least two of copying, printing, facsimile transmission, plotting, and scanning capabilities and, more particularly, to an image forming apparatus to which a relay unit and a sheet processing apparatus are coupled.

Description of the Related Art

In typical image forming apparatuses such as copiers and printers, when sheets of recording media on which images are formed are output, the sheet is given stiffness to suppress curl of the sheet. Giving stiffness to sheets is also called "corrugation". In corrugation, a wavy shape is given to the sheet, and an apex of the wavy shape extends in the direction in which the sheet is transported (output). Having stiffness, the sheet output to an output tray can be free of winding and curl.

SUMMARY

In an embodiment of the present invention, an image forming apparatus includes an image forming unit to from an image on a sheet, a sheet ejection section to which a relay unit and a sheet processing apparatus are removably coupled, a driving-side ejection roller disposed in the sheet ejection section, to eject the sheet bearing the image outside the image forming apparatus, a plurality of driven-side ejection rollers replaceable with each other, one of which is disposed facing the driving-side ejection roller and serving as an ejection roller pair together with the driving-side ejection roller, and a roller holder removably secured to the sheet ejection section to hold the one of the plurality of driven-side ejection rollers. Each of the plurality of driven-side ejection rollers has a shaft and a plurality of roller bodies attached to the shaft. The plurality of roller bodies is lined in an axial direction of the shaft. The driven-side ejection roller is replaced with another driven-side ejection roller in accordance with whether or not the relay unit and the sheet processing apparatus are coupled to the sheet ejection section.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
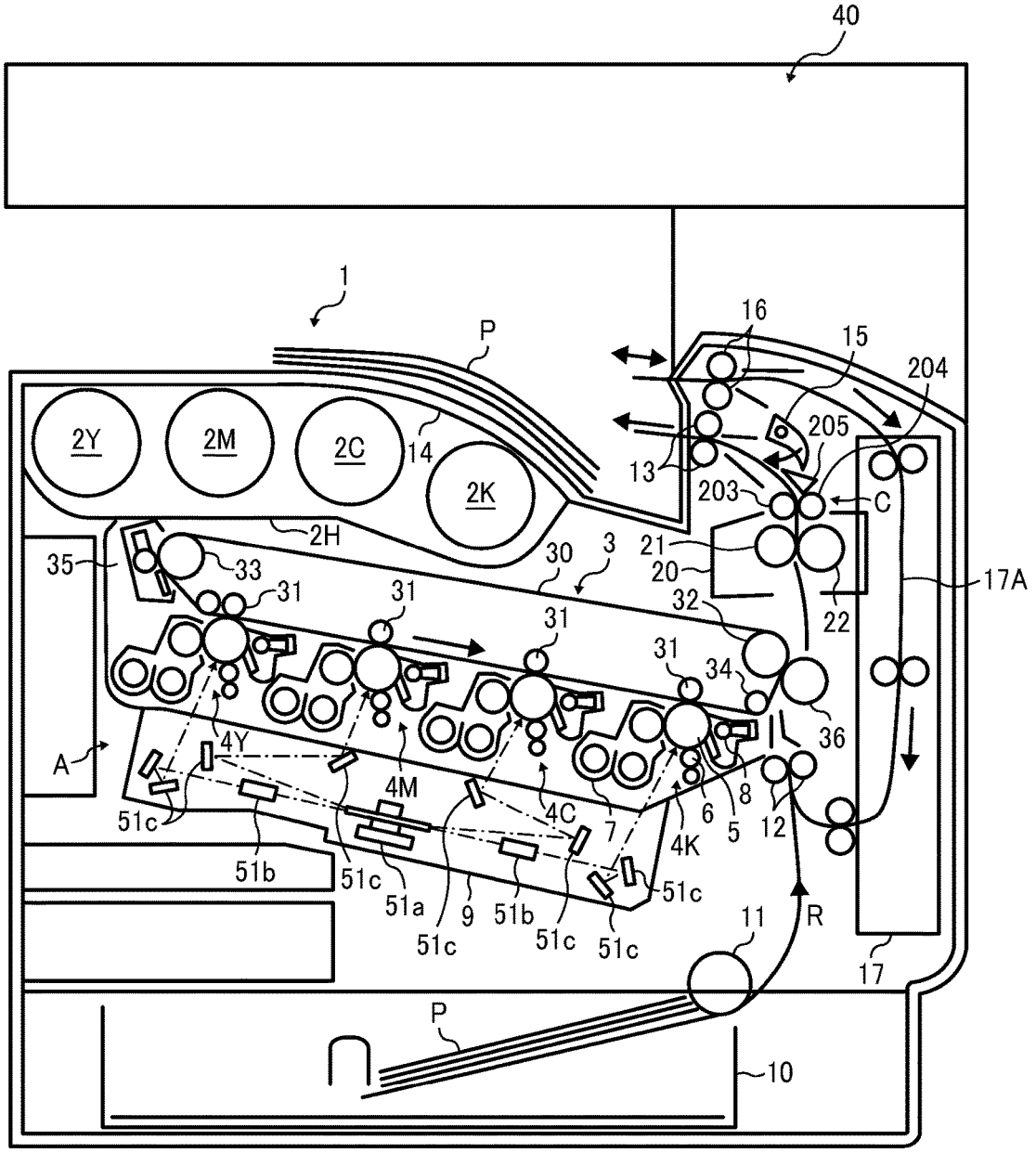
FIG. 1 is a schematic view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Image forming apparatuses can have a capability to turn on and off the corrugation. It is possible that, in configurations in which various types of sheet processing apparatuses are coupled to the sheet ejection section of the image forming apparatus, the conveyance of the sheet provided with corrugation becomes defective at the connection between the image forming apparatus and the sheet processing apparatus or inside the sheet processing apparatus. For example, when the sheet conveyance path is curved inside sheet processing apparatus, the sheet provided with corrugation fails to conform to the curved sheet conveyance path, resulting in defective conveyance.

It is conceivable to automatically move a device to execute the corrugation, thereby automatically turning on and off the corrugation. The capability to automatically turn on and off the corrugation, however, can make the structure more complicated and increase the cost.

In view of the foregoing, in the embodiments described below, sheet stiffening setting is changeable to inhibit defective conveyance of the sheet while keeping the image forming apparatus compact and facilitating the work related to turning on and off corrugation or decurling.

Referring now to the drawings, wherein like reference numerals designate identical or corresponding parts throughout the several views thereof, and particularly to FIG. 1, a multicolor image forming apparatus according to an embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

With reference to FIG. 1, an entire structure and operation of an image forming apparatus 1 according to Embodiment 1 is described.

Embodiment 1

The image forming apparatus 1 illustrated in FIG. 1 is a multicolor laser printer, for example, and includes four image forming units 4Y, 4M, 4C, and 4K positioned at a center of the apparatus, and an image reading section 40. In the image forming apparatus 1, the section where the image forming units 4Y, 4M, 4C, and 4K (collectively "image forming units 4") are disposed is referred to as an image forming section A. The image forming units 4Y, 4M, 4C, and 4K have a similar structure except the color of toner, namely, yellow (Y), magenta (M), cyan (C), or black (K), that corresponds to color separation component of multicolor images.

Specifically, each of the image forming units 4Y, 4M, 4C, and 4K includes a drum-shaped photoconductor 5 as a latent image bearer, a charger 6 to charge a surface of the photoconductor 5, a developing device 7 to supply toner to the surface of the photoconductor 5, and a cleaning device 8 to clean the surface of the photoconductor 5. In FIG. 1, reference numerals are given only to the photoconductor 5, the charger 6, the developing device 7, and the cleaning device 8 of the black image forming unit 4K, and reference numerals of components of other image forming units 4Y, 4M, and 4C are omitted.

An exposure device 9 to expose the surface of the photoconductors 5 is disposed below the image forming units 4Y, 4M, 4C, and 4K. The exposure device 9 includes a light source, a polygon mirror 51*a*, f-θ lenses 51*b*, and reflection mirrors 51*c*, and is configured to direct laser beams onto the surfaces of the photoconductors 5 according to image data.

A transfer device 3 is disposed above the image forming units 4Y, 4M, 4C, and 4K. The transfer device 3 includes an intermediate transfer belt 30 as an intermediate transfer member, four primary transfer rollers 31 as primary transfer members, a secondary transfer backup roller 32, a cleaning backup roller 33, a tension roller 34, and a belt cleaning device 35.

The intermediate transfer belt 30 is an endless belt entrained around the secondary transfer backup roller 32, the cleaning backup roller 33, and the tension roller 34. As the secondary transfer backup roller 32 rotates, the intermediate transfer belt 30 rotates in the direction indicated by an arrow in the figure.

The four primary transfer rollers 31 press against the respective photoconductors 5 with the intermediate transfer belt 30 interposed therebetween, and four contact portions therebetween are called "primary transfer nips". Each primary transfer roller 31 is electrically connected to a power supply and receives a predetermined amount of voltage including at least one of direct-current (DC) voltage and alternating current (AC) voltage.

The secondary transfer roller 36 nips the intermediate transfer belt 30 together with the secondary transfer backup roller 32 to form a secondary transfer nip. In addition, similar to the primary transfer rollers 31, the secondary transfer roller 36 is connected to a power supply, and a predetermined direct current (DC) voltage or alternating current (AC) voltage is applied to the secondary transfer roller 36.

The belt cleaning device 35 includes a cleaning brush and a cleaning blade, which are disposed to contact or abut on the intermediate transfer belt 30. A waste toner conveyance hose (tube) is coupled to the belt cleaning device 35, and waste toner collected by the belt cleaning device 35 is transported therethrough to a waste toner container.

A bottle holder 2H is disposed in an upper part of the apparatus body. Four toner bottles 2Y, 2M, 2C, and 2K each containing toner for replenishment are removably mounted in the bottle holder 2H. The toner is supplied to each developing device 7 from the corresponding one of the toner bottles 2Y, 2M, 2C, and 2K through a supply path.

In a lower section of the apparatus body, a sheet feeding tray 10 for containing sheets P of recording media and a sheet feeding roller 11 to feed the sheets P from the sheet feeding tray 10 are disposed. The recording media include, in addition to standard copy paper, heavy paper, post cards, thin paper such as tracing paper, coated paper, overhead projector (OHP) films, and special purpose sheets. The image forming apparatus 1 can further include a bypass sheet feeder or a manual sheet feeder.

A sheet feeding path R is inside the apparatus body for conveying the sheet P from the sheet feeding tray 10 to the secondary transfer nip and further to the outside the image forming apparatus 1. A registration roller pair 12 serving as a timing roller pair to convey the sheet P to the secondary transfer nip at an appropriate timing for conveyance is disposed upstream in the sheet conveyance direction from the secondary transfer roller 36 in the sheet feeding path R.

The fixing device 20 to fix an unfixed image on the sheet P is disposed upstream in the sheet conveyance direction from the secondary transfer roller 36. Further, an ejection roller pair 13 to eject the sheet P outside the apparatus is disposed downstream from the fixing device 20 in the sheet feeding direction of the feeding path R, and an output tray 14 to store the sheets P is disposed on the upper face of the apparatus body.

It is to be noted that, to the image forming apparatus 1, a relay unit 1701 and a sheet processing apparatus 1900 (see FIG. 17) can be coupled.

Referring to FIG. 1, operation of the image forming apparatus according to the present embodiment is described below.

When an image forming operation is started, the photoconductor 5 of each of the image forming units 4Y, 4M, 4C, and 4K is driven to rotate clockwise in FIG. 1, and the charger 6 charges the surface of the photoconductor 5 uniformly in a predetermined polarity. The exposure device 9 directs laser beams to the charged surfaces of the photoconductors 5, and an electrostatic latent image is formed on the surface of each photoconductor 5. More specifically, the exposure device 9 directs the laser beams according to single color data, namely, yellow, cyan, magenta, and black color data decomposed from full-color image data to the surfaces of the photoconductors 5. The electrostatic latent images on the photoconductors 5 are developed into toner images (visible images) with toner supplied by the respective developing devices 7.

Additionally, when the image forming operation is started, the secondary transfer backup roller 32 rotates counterclockwise in the drawing, and the intermediate transfer belt 30 rotates in the direction indicated by an arrow in the figure. The predetermined voltage (i.e., transfer bias voltage), opposite in polarity to toner, is applied to the primary transfer rollers 31, thus generating transfer electrical fields in the primary transfer nips. The transfer bias voltage is under either constant-voltage control or constant-current control.

The transfer electrical fields generated in the primary transfer nips transfer the toner images from the respective photoconductors 5 and superimpose the toner images one on another on the intermediate transfer belt 30. Thus, a multicolor toner image is formed on the intermediate transfer belt 30. After primary transferring, the cleaning devices 8 remove toner remaining on the respective photoconductors 5. Thereafter, a discharger removes electric charge from the surface of each photoconductor 5 to initialize the surface potential.

In the lower section of the image forming apparatus 1, the sheet feeding roller 11 starts rotating, sending out the sheet P from the sheet feeding tray 10 to the sheet feeding path R. Then, the registration roller pair 12 stops the sheet P temporarily.

The registration roller pair 12 starts rotating at a predetermined timing to transport the sheet P to the secondary transfer nip, timed to coincide with the arrival of the toner image on the intermediate transfer belt 30. At that time, the transfer bias voltage opposite in polarity to a charge polarity of the toner image on the intermediate transfer belt 30 is applied to the secondary transfer roller 36, and thus the transfer electrical field is generated in the secondary transfer nip. The transfer electrical field transfers the superimposed toner images from the intermediate transfer belt 30 onto the sheet P at a time. Subsequently, the belt cleaning device 35 removes toner (i.e., waste toner) remaining on the intermediate transfer belt 30, and the waste toner is collected in the waste toner container.

Subsequently, the toner image is fixed on the sheet P by the fixing device 20. A divider 15 (i.e., a branching claw) is disposed downstream from the fixing device 20 to switch the sheet conveyance route. As illustrated in FIG. 1, an end of the divider 15 is pivotably supported, and the divider pivots around a support point to guide the sheet P conveyed from the fixing device 20 to either a route to eject the sheet P (a sheet ejection path 1703 illustrated in FIG. 16) outside the apparatus or a reversing path 17A for duplex printing. Between the divider 15 and the fixing device 20, a curl correction structure C (i.e., a decurler) is disposed. The curl correction structure C includes a driving roller 204, a driven roller 203, and a movable guide 205 pivotable around a support 205*a*.

In single-side printing, the divider 15 is open to guide the sheet P to the ejection roller pair 13, and the sheet P is ejected onto the output tray 14 on the upper face of the apparatus. The image forming apparatus 1 according to the present embodiment is housing-internal discharge type, that is, the output tray 14 is disposed inside a housing thereof. The space above the output tray 14 (the apparatus body) and below the image reading section 40 is hereinafter referred to as "housing-internal space 1704" (illustrated in FIGS. 16 and 18).

In duplex printing, the divider 15 closes to the left in FIG. 1, as indicated by an arrow, to guide the sheet P to the reversing path 17A after the toner image is fixed on the first side of the sheet P. In the reversing path 17A, a reversing roller pair 16 switchbacks the sheet P to a sheet reversing unit 17, through which the sheet P is again conveyed to the registration roller pair 12. Then, a toner image is printed on a second side (i.e., a back side) of the sheet P similarly to the first side. The ejection roller pair 13 discharges the sheet P outside the apparatus and stacks the sheet P on the output tray 14.

Although the description above relates to full-color image formation, alternatively, single color, bicolor, and three-color images can be formed using one, two, or three out of the four image forming units 4.

Figure 2:
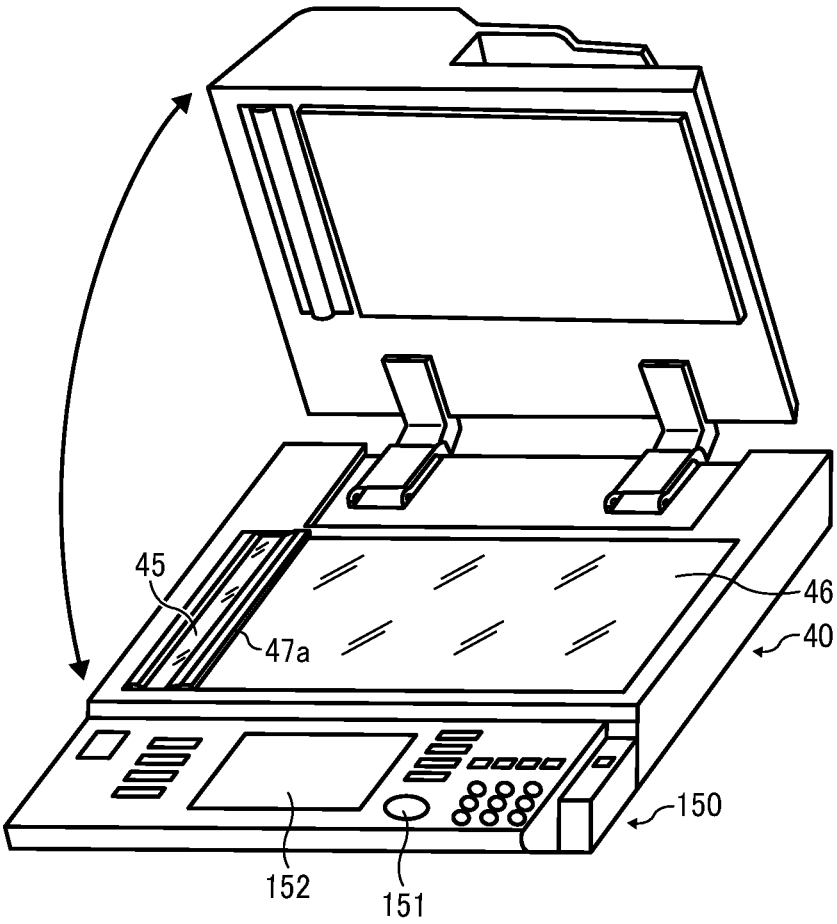
FIG. 2 is a schematic view of an image reading device of an image forming apparatus illustrated in FIG. 1.

As illustrated in FIG. 1, the image reading section 40 is disposed above the apparatus body of the image forming apparatus 1. As illustrated in FIG. 2, the image reading section includes a first exposure glass 45 disposed in a feeding path of a document to be scanned, a second exposure glass 46 on which the document is mountable, and a positioning guide 47*a* to contact one side of the document to position the document. Additionally, a control panel 150 is disposed on a front side of the upper section of the image forming apparatus 1.

The control panel 150 includes a print key 151 and a display 152 (e.g., a touch panel). When the print key 151 is pressed, the image forming apparatus 1 is instructed to start copying. The display 152 displays various types of information relating to printing and the like, and users can input instructions via the display 152.

Figure 3:
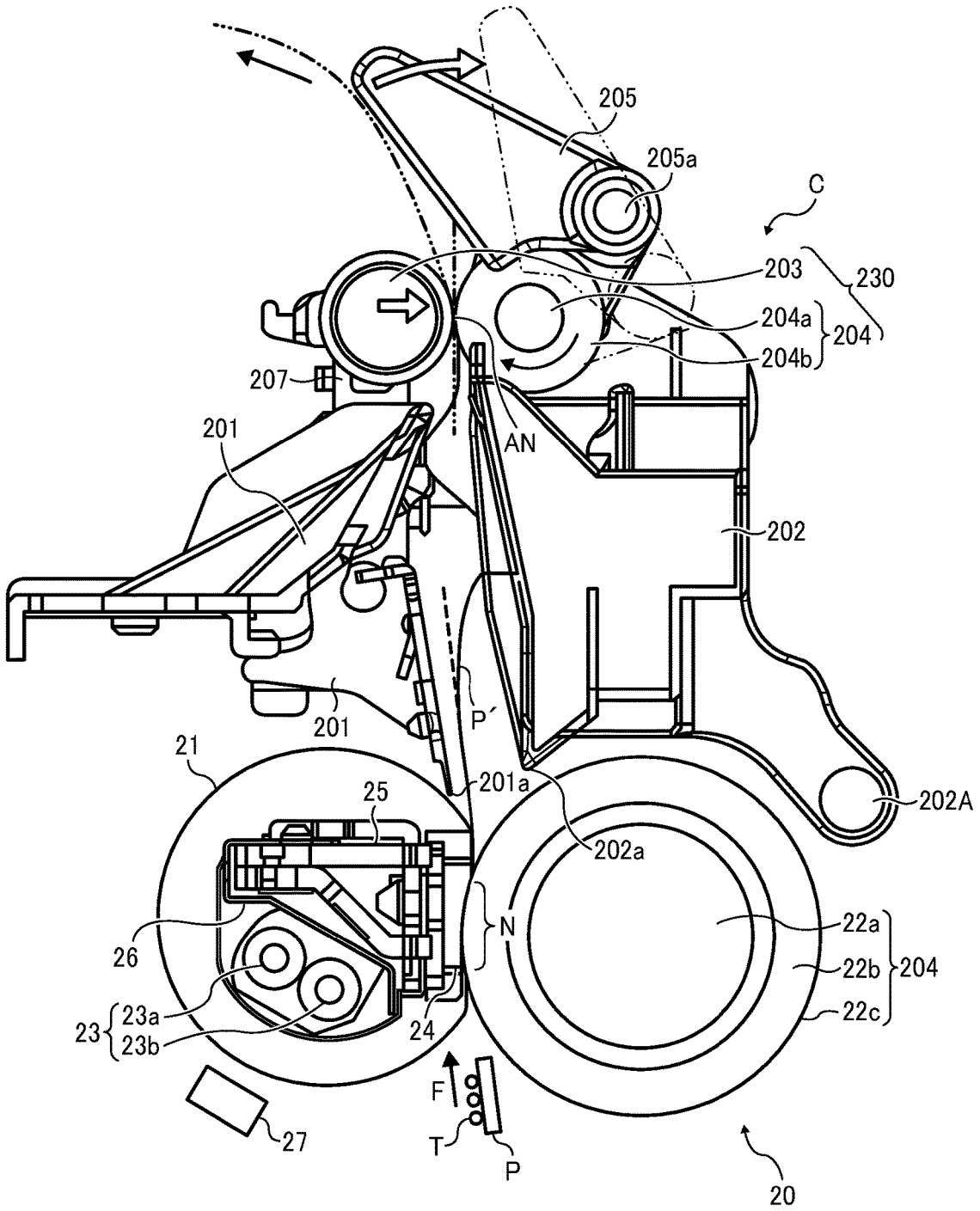
FIG. 3 is a schematic view of a curl correction structure and a fixing device according to Embodiment 1.

Referring to FIG. 3, descriptions are given below of a curl correction structure (i.e., a decurler) and the fixing device according to the present embodiment. FIG. 3 is a cross-sectional view of the curl correction structure and the fixing device.

In FIG. 3, reference character "T" represents the toner image on the sheet P. As illustrated in FIG. 3, the fixing device 20 fuses the toner image T to permeate the sheet P, with heat and pressure. The fixing device 20 includes a flexible, endless fixing belt 21 that rotates while being heated.

In addition to the fixing belt 21, the fixing device 20 includes a pressure roller 22, serving as an opposing rotator, to rotate while being in contact with the fixing belt 21. The pressure roller 22 presses against the pressure roller 22, and the contact portion therebetween is referred to as a fixing nip N. A heater 23 (i.e., a heat source) including a plurality of halogen lamps 23*a* and 23*b* is disposed inside the loop of the fixing belt 21 to heat the inner side of the fixing belt 21.

Inside loop of the fixing belt 21, a nip forming pad 24 (i.e., a nip forming member), serving as a base to nip the fixing belt 21 together with the pressure roller 22, a stay 25 to support the nip forming pad 24, and a reflector 26 to reflect light emitted from the heater 23 to the fixing belt 21 are disposed. The nip forming pad 24 includes a low-friction sheet (i.e., a slidable sheet) wound around a base pad.

Although the nip forming pad 24 has a flat face facing the fixing belt 21 so that the fixing nip N is flat, the fixing nip N is not necessarily flat. For example, when the fixing nip N is recessed confirming to the circumference (in the shape of arc) of the pressure roller 22, the leading end of the sheet P passing through the fixing nip N comes to the side of the pressure roller 22, which is advantageous in improving separation of the sheet P from the fixing belt 21. The temperature of the fixing belt 21 is detected by a temperature sensor 27 disposed on an entrance side of the fixing nip N in the sheet conveyance direction indicated by arrow F in FIG. 3, and the temperature is used for feedback processing of the heater 23. In FIG. 3, an arrow F indicates the direction in which the sheet P is conveyed, and P' represents the sheet P after the fixing.

The fixing belt 21 is a flexible, thin endless belt shaped into a sleeve. The pressure roller 22 includes a base and a release layer overlying the base. Example materials of the base include metal materials such as nickel and Steel Use Stainless (SUS) according to Japan Industrial Standard (JIS) and resin materials such as polyimide. Example materials of the release layer, having releasability from toner, include copolymer of tetrafluoroethylene-perfluoroalkyl vinylether (PFA) and polytetrafluoroethylene (PTFE).

The pressure roller 22 includes a metal core 22*a*; an elastic layer 22*b* disposed on the surface of the metal core 22*a*, which is made of or includes foamed silicon rubber, silicon rubber, or the fluoro-rubber; and a release layer 22*c* disposed on the elastic layer 22*b*, which is made of or includes PFA or PTFE. The fixing device 20 further includes a pressure member to press the pressure roller 22 against the nip forming pad 24 serving as the base, while being in contact with the fixing belt 21. For example, the pressure member is a spring to exert resilience, a sponge to exert elasticity, or a solenoid to exert electromagnetic force.

In the portion where the pressure roller 22 and the fixing belt 21 contact each other, the elastic layer 22*b* of the pressure roller 22 is squeezed, generating pressure between the pressure roller 22 and the nip forming pad 24. With the pressure, the nip forming pad 24 secures the fixing nip N having a predetermined width.

The pressure roller 22 is rotated by a driving source such as a motor disposed in the apparatus body. Further, when the pressure roller 22 is driven, the driving force is transmitted from the pressure roller 22 to the fixing belt 21 in the fixing nip N, thereby rotating the fixing belt 21.

In the structure illustrated in FIG. 3, the pressure roller 22 is a solid-core roller, but the pressure roller 22 can be a hollow roller. When the pressure roller 22 is a hollow roller, a heat source such as a halogen heater using radiation heat can be disposed inside the pressure roller 22. If the pressure roller 22 does not include an elastic layer, the thermal capacity of the pressure roller 22 decreases and the fixing capability is improved. When the unfixed toner is pressed and fixed, however, minute surface unevenness of the belt surface is transferred to unfixed toner, making the gloss of solid image portions uneven. To prevent such uneven gloss, the elastic layer with a thickness of 100 μm or more is preferred. For the hollow roller, a metal pipe made of aluminum, iron, stainless steel, or the like can be used.

When a heat source is disposed inside the pressure roller 22, it is preferred that a heat insulation layer or a heat ray reflection surface by mirror finishing be disposed on the surface of a substrate to prevent the substrate from being heated with the radiation heat from the heat source. In this case, not limited to the above-described halogen heater, an induction heating (IH) heater, a resistance heat generator, or a carbon heater can be used for the heat source.

The sheet P that has passed through the fixing nip N is separated from the fixing belt 21 and the pressure roller 22 and guided to the ejection roller pair 13 by a belt-side separator 201 and a pressure-side separator 202 (a separation and conveyance device) disposed adjacent to the fixing nip N and on an exit side of the fixing nip N in the direction indicated by arrow F in FIG. 3. Specifically, the belt-side separator 201 has an end 201*a* that approaches the fixing belt 21 on the downstream side of the fixing nip N in the sheet conveyance direction indicated by arrow F. The pressure-side separator 202 has a swingable end 202*a* that approaches the pressure roller 22.

The belt-side separator 201 is to peel off the leading end of the sheet P, which tends to adhere to the fixing belt 21, from the fixing belt 21. Accordingly, the belt-side separator 201 includes a metal plate to attain a positioning precision to position the sheet P at a position floating from the pressure roller 22.

For the pressure-side separator 202, a molded resin component is used. The pressure-side separator 202 includes a support rod 202A rotatably supported by the apparatus body so that the swingable end 202*a* of the pressure-side separator 202 facing the pressure roller 22 contacts and moves away from the pressure roller 22. The pressure-side separator 202 swings relative to the pressure roller 22. For example, in removal of a jammed sheet from the fixing nip N, the pressure-side separator 202 swings to part from the pressure roller 22, making a large space for insertion of a hand in the fixing nip N. With this structure, users or operators can access the sheet P to be removed.

Downstream from the belt-side separator 201 and the pressure-side separator 202 in the sheet conveyance direction, the driving roller 204 and the driven roller 203, which is supported by a holder 207, is disposed. The driving roller 204 and the driven roller 203 together serve as a conveyance-assist roller pair 230.

In the present embodiment, the driving roller 204 includes a metal core 204*a* (serving as a roller shaft) and a solid rubber layer 204*b* (corresponding to a short cylindrical part) overlying the metal core 204*a*. The solid rubber layer 204*b* is made of or includes a material having a higher friction coefficient, such as silicon, EPDM, urethane, and fluorine rubber, to attain sheet feeding capability. The driven roller 203 includes a hollow metal pipe and a tube overlying the metal pipe. The tube is made of PFA, polytetrafluoroethylene (PTFA), fluorinated ethylene propylene (FEP), or the like and has a small depth ranging 30 μm to 300 μm.

During image fixing, vapor emanates from the sheet P and condenses. To prevent dew condensation on the driven roller 203, the hollow pipe is used to reduce the thermal capacity thereof so that the driven roller 203 is heated quickly by the heat from the fixing device 20.

During fixing, a small amount of toner fails to melt or incompletely melts. Therefore, the small-depth tube is disposed as the surface layer of the driven roller 203 to inhibit the toner from adhering to the driven roller 203 and from accumulating thereon even when the toner adheres. The above-described configuration is adopted because the driven roller 203 feeds the sheet P while constantly contacting an image side of the sheet P. By contrast, the driving roller 204 contacts the opposite side of the sheet P. The holder 207 supporting the driven roller 203 is pressed by a spring so that the driven roller 203 contacts the driving roller 204, thereby forming an auxiliary nip AN to assist sheet conveyance.

Figure 4:
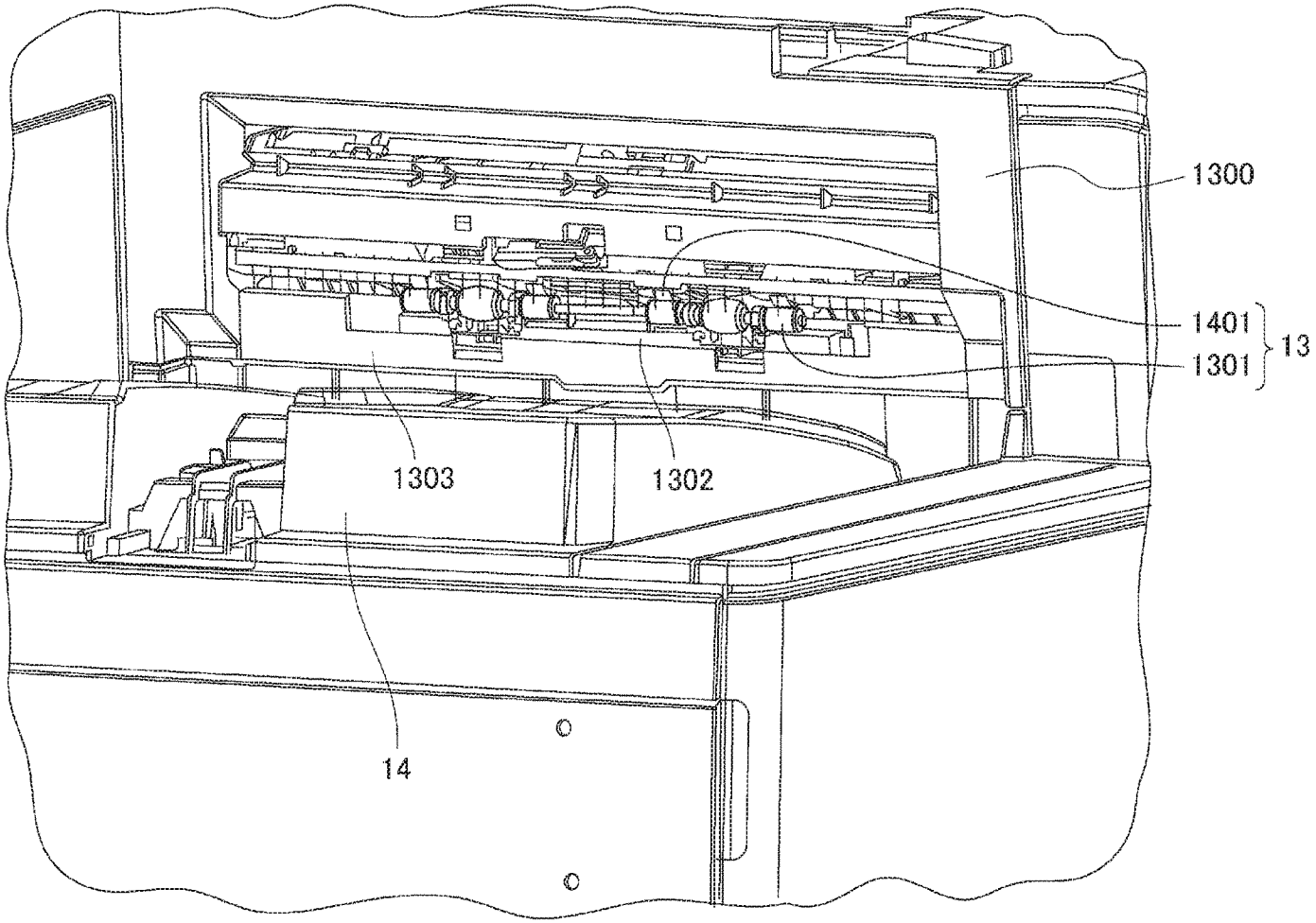
FIG. 4 is a perspective view of a sheet ejection section of the image forming apparatus according to Embodiment 1.
Figure 5:
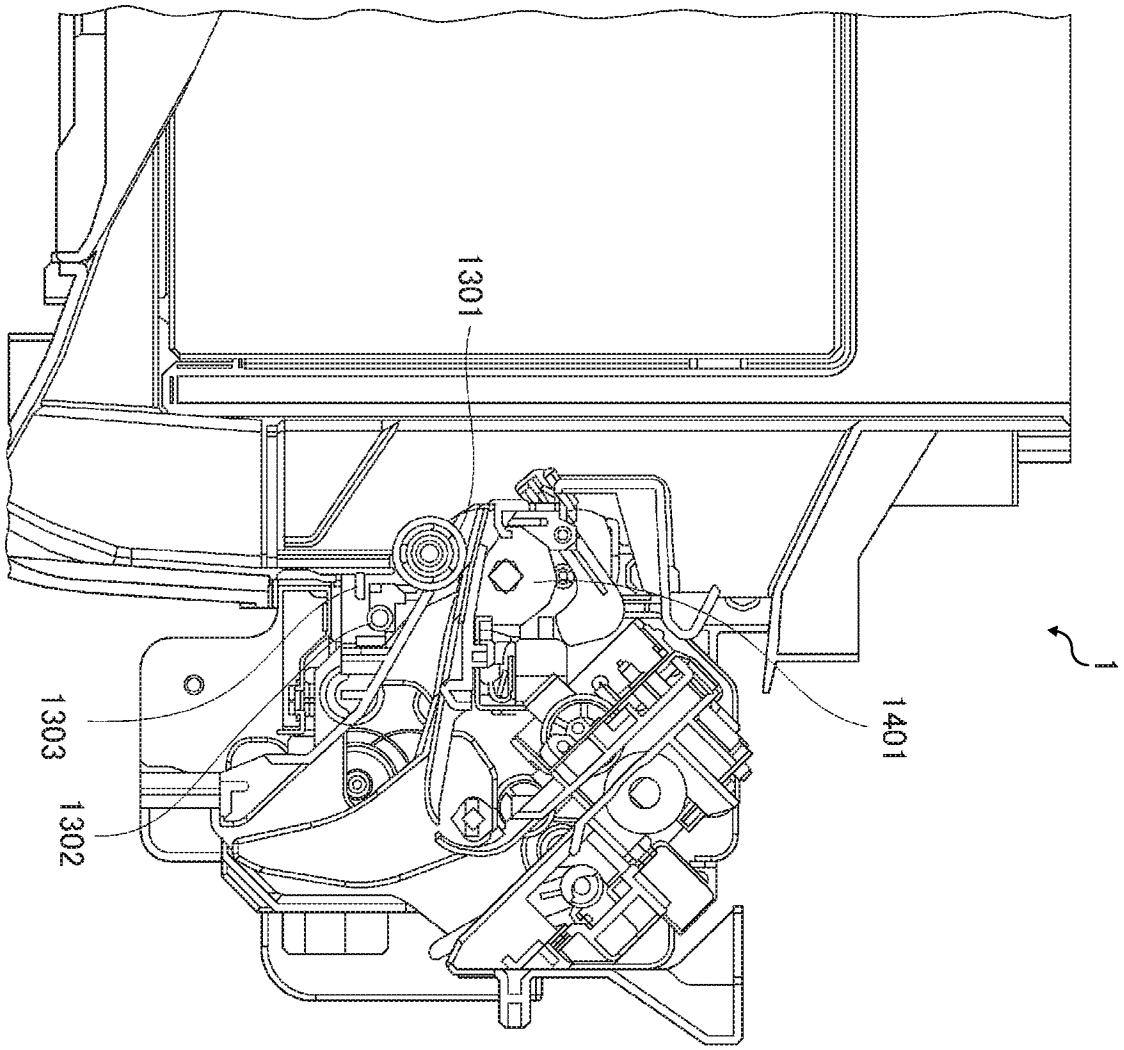
FIG. 5 is a cross-sectional view of the sheet ejection section according to Embodiment 1.

Referring to FIGS. 4 and 5, a sheet ejection section according to the present embodiment is described.

FIGS. 4 and 5 are respectively a perspective view and a cross-sectional view of a sheet ejection section 1300 of the image forming apparatus 1 illustrated in FIG. 1. The sheet ejection section 1300 includes the ejection roller pair 13, which includes sheet ejection rollers 1301 and 1401, a roller holder 1302, an ejection guide plate 1303, and the output tray 14.

The ejection roller pair 13 discharges the sheet P to the output tray 14, which is a housing-internal output tray.

The sheet ejection roller 1401 is a driving roller to which a driving force is transmitted from a driving source such as a motor. The sheet ejection roller 1301 is pressed by a spring to the sheet ejection roller 1401 and rotates due to the pressure by the spring as the sheet ejection roller 1401 rotates. That is, the sheet ejection roller 1301 is a driven-side ejection roller. The sheet ejection roller 1301 is removably attached to the ejection guide plate 1303 via the roller holder 1302.

Referring to FIGS. 6 through 9, the ejection roller pair 13 is described in further detail below. As described later, in the present embodiment, the type of the driven-side ejection roller (the sheet ejection roller 1301 or 1800) is changed in accordance with the conveyance route of the sheet P ejected from the sheet ejection section 1300.

Figure 6:
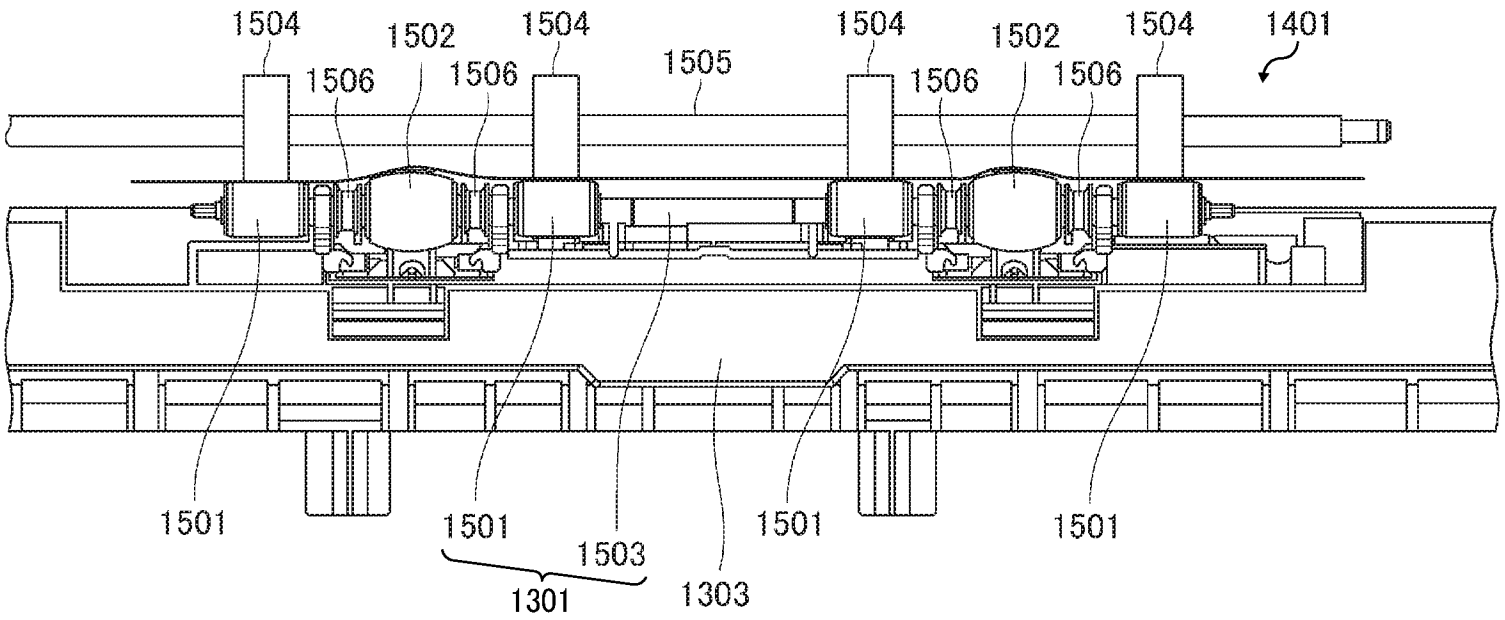
FIG. 6 is a front view of an ejection roller pair according to Embodiment 1.
Figure 7:
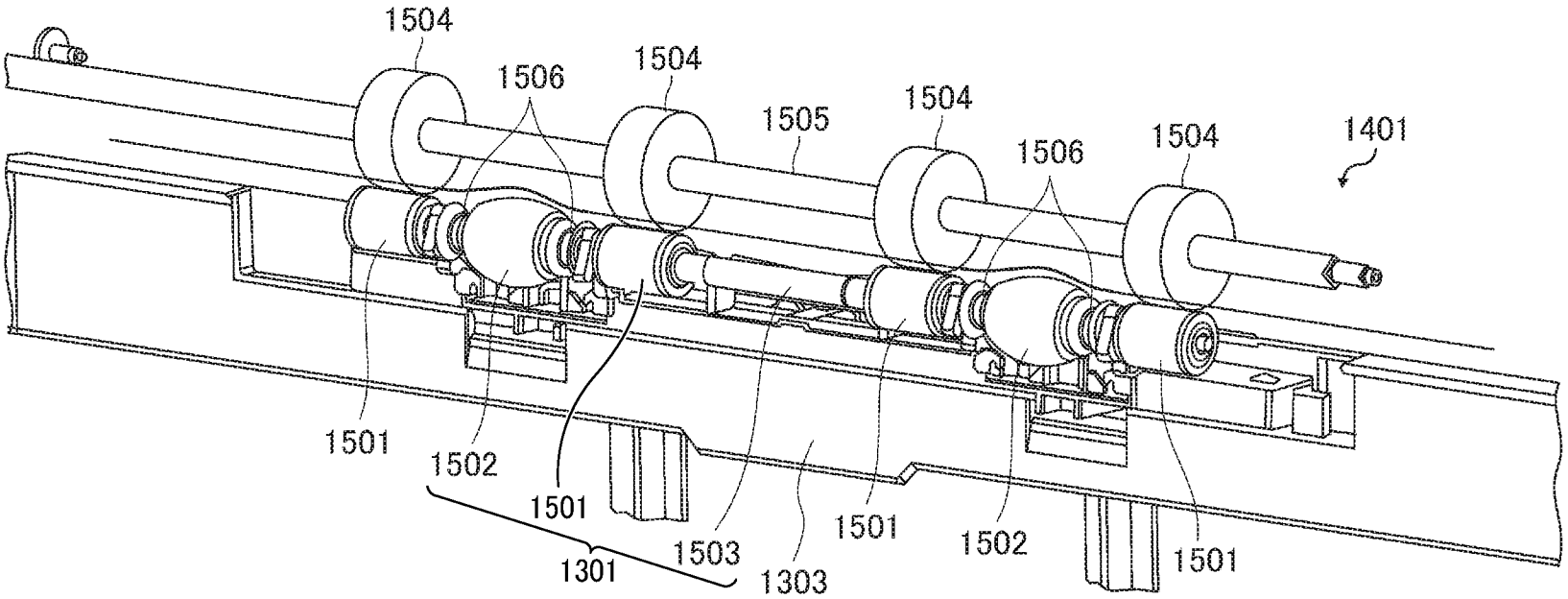
FIG. 7 is a perspective view of the ejection roller pair according to Embodiment 1.

The sheet ejection roller 1301 illustrated in FIGS. 6 and 7 is to give corrugation on the sheet P. FIG. 6 is a front view of the sheet ejection roller 1301, and FIG. 7 is a perspective view of the sheet ejection roller 1301.

The sheet ejection roller 1301 includes multiple roller bodies 1501, multiple roller bodies 1502, a shaft 1503, and multiple spring-receiving roller bodies 1506. The term "roller bodies" used in this specification means rollers (cylindrical bodies) supported by a single shaft and disposed intermittently in the axial direction of the shaft. The sheet ejection roller 1401 includes multiple roller bodies 1504 to which the respective roller bodies 1501 press, forming nips. In the present embodiment, the roller bodies 1501 and the roller bodies 1502 are made of polyoxymethylene (POM, or polyacetal) resin, for example. Although four roller bodies 1501 are disposed on the shaft 1503 in the present embodiment, the number of the roller bodies 1501 is not limited thereto. The roller bodies 1502 are greater in diameter than the roller bodies 1501 to give stiffness to the sheet P. Thus, the sheet ejection roller 1301 serves as a different-diameter roller having the multiple roller bodies different in diameter. Although two roller bodies 1502 are disposed on the shaft 1503 in the present embodiment, the number of the roller bodies 1502 is not limited thereto.

The shaft 1503 serves as an axis of rotation of the sheet ejection roller 1301, and the roller bodies 1501 and the roller bodies 1502 are attached to the shaft 1503. The roller body 1502 having the greater diameter is disposed adjacent to the roller body 1501 so that corrugation is made on the sheet P with the difference in height between the roller bodies 1501 and 1502.

There are two pairs of spring-receiving roller bodies 1506 disposed on the shaft 1503, with one roller body 1502 interposed in each pair of spring-receiving roller bodies 1506. At least a part of the roller bodies 1502 is provided with the spring-receiving roller bodies 1506. Although the two roller bodies 1502 are provided with the spring-receiving roller bodies 1506 in the present embodiment, the number of the roller bodies 1502 provided with the spring-receiving roller bodies 1506 is not limited thereto. The spring-receiving roller body 1506 contacts (or abuts against) a spring 1605 (illustrated in FIG. 12) attached to the roller holder 1302 and receives a biasing force from the spring 1605.

The sheet ejection roller 1401 includes a shaft 1505 and the multiple roller bodies 1504 attached to the shaft 1505. The sheet ejection roller 1401 is attached to (secured to) the body of the image forming apparatus 1. The roller bodies 1504 are disposed facing the respective roller bodies 1501 of the roller bodies 1504, forming the nips.

Figure 8:
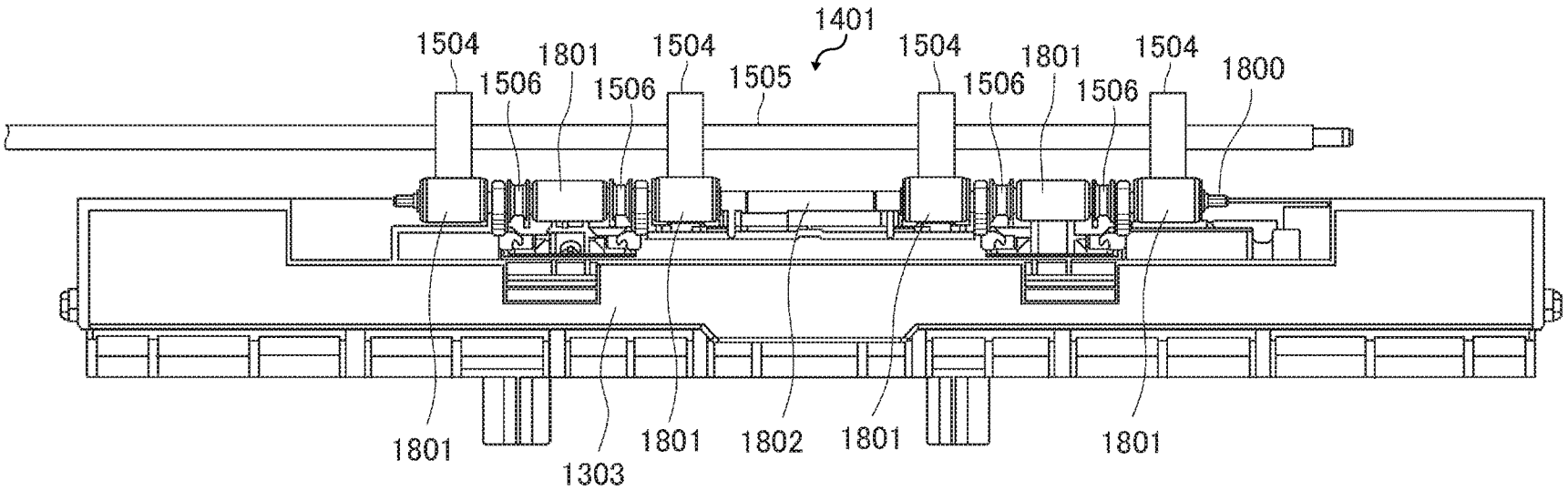
FIG. 8 is a front view of the ejection roller pair according to Embodiment 1.
Figure 9:
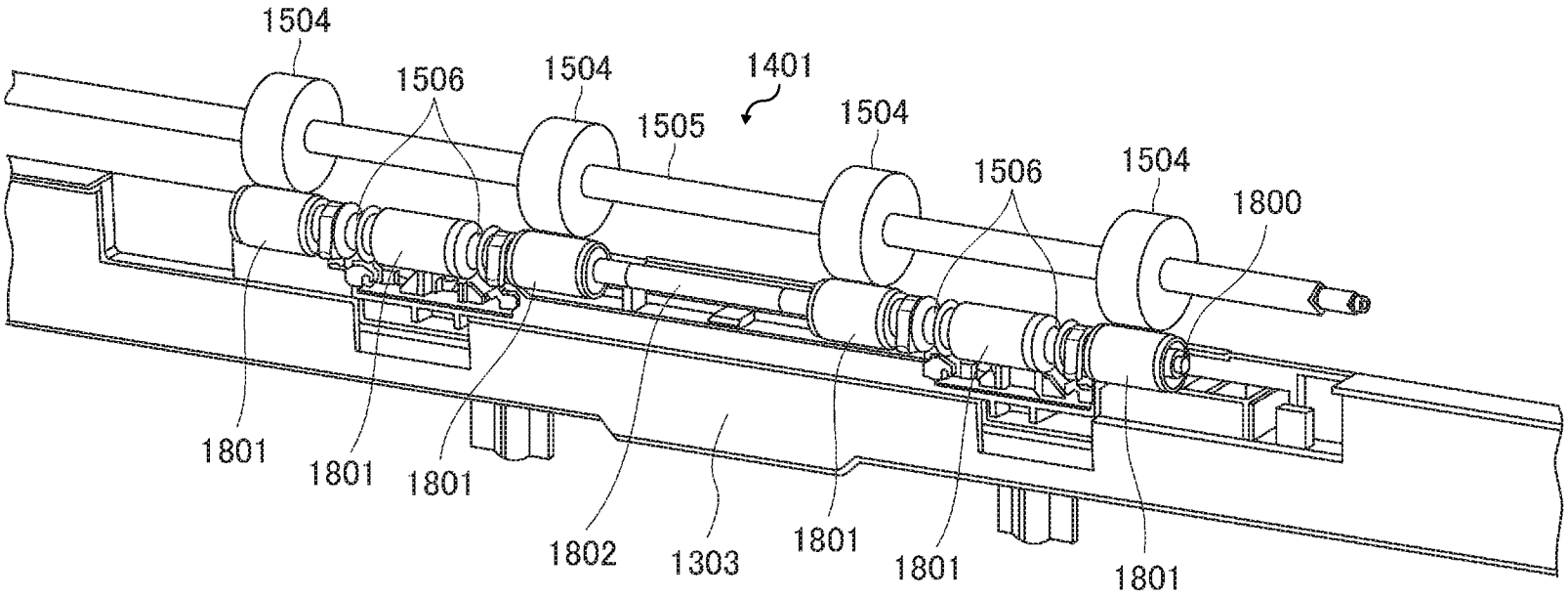
FIG. 9 is a perspective view of the ejection roller pair according to Embodiment 1.

Next, descriptions are given below of the sheet ejection roller 1800 that does not make corrugation on the sheet P with reference FIGS. 8 and 9. FIG. 8 is a front view of the sheet ejection roller 1800, and FIG. 9 is a perspective view of the sheet ejection roller 1800.

The sheet ejection roller 1800 includes a shaft 1802 and multiple roller bodies 1801 attached to the shaft 1802. Some of the multiple roller bodies 1801 press to the sheet ejection rollers 1401 to form nips. Although four roller bodies 1801 are disposed on the shaft 1802 in the present embodiment, the number of the roller bodies 1801 is not limited thereto. The sheet ejection roller 1800 serves as another driven-side ejection roller.

In one embodiment, some of the roller bodies 1801 have the diameter to form nips with the roller bodies 1504, and the rest have a smaller diameter. In the present embodiment, the sheet ejection roller 1800 serves as an equal-diameter roller in which the multiple roller bodies 1801 are equal or similar in diameter, and the diameter is set to form the nips with the roller bodies 1504 of the sheet ejection roller 1401. With this configuration, there is no difference in height among the roller bodies 1801. Accordingly, stiffness is not given to the sheet P passing between the sheet ejection roller 1401 and the sheet ejection roller 1800.

The shaft 1802 serves as an axis of rotation of the sheet ejection roller 1800, and the roller bodies 1801 are attached to the shaft 1802. The sheet ejection roller 1401 illustrated in FIGS. 8 and 9 have the same structure as that illustrated in FIGS. 6 and 7.

Figure 10A:
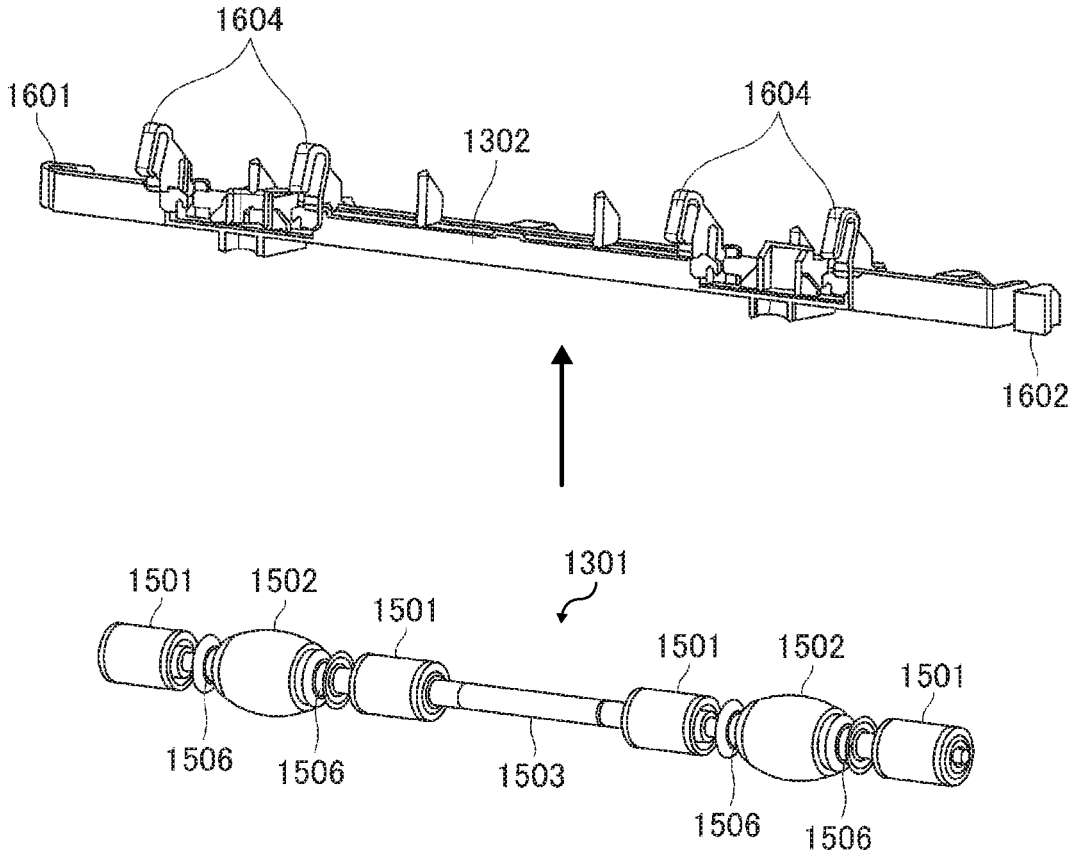
FIG. 10A is an exploded view illustrating attachment of a sheet ejection roller to a roller holder according to Embodiment 1.
Figure 10B:
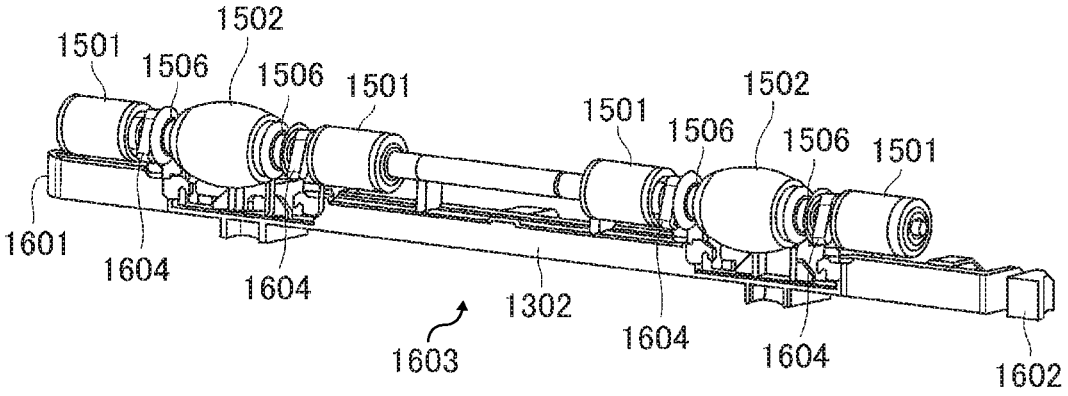
FIG. 10B is the sheet ejection roller to the roller illustrated in FIG. 10A.
Figure 11:
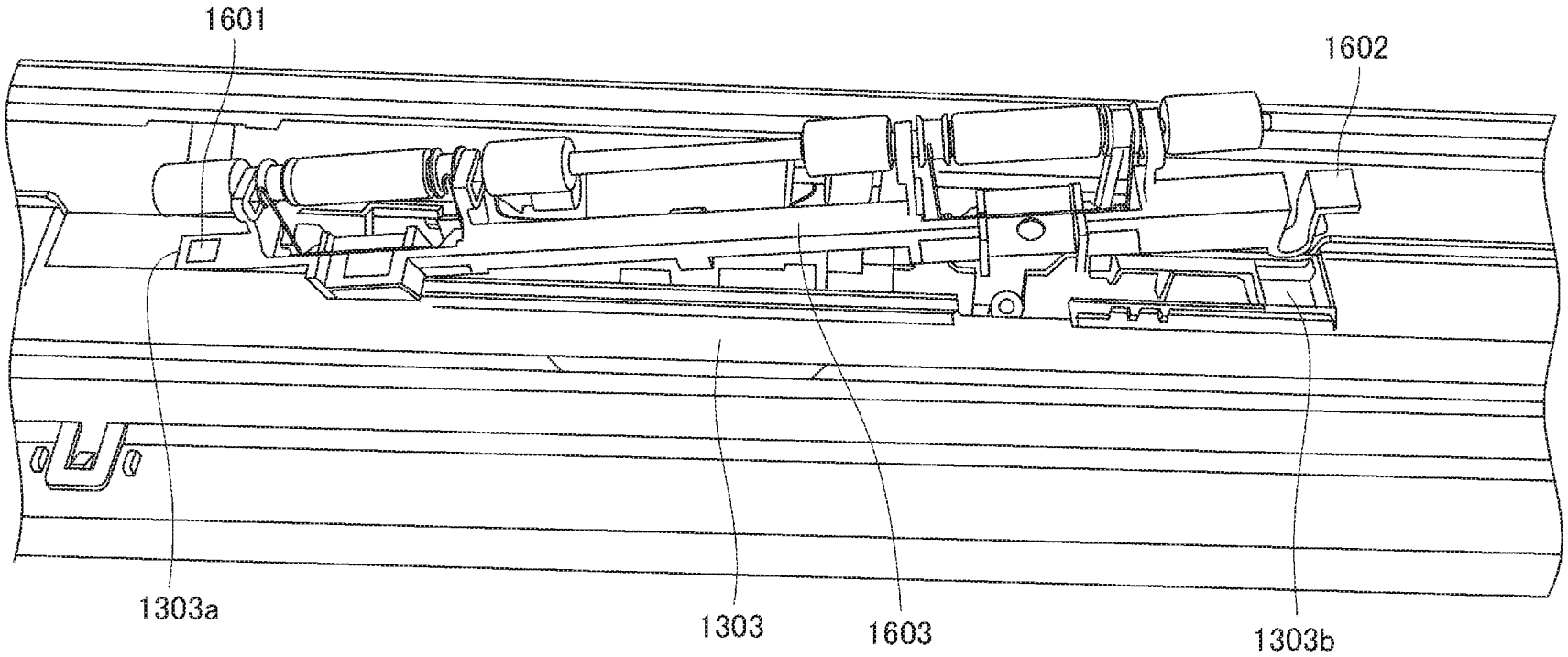
FIG. 11 is a perspective view illustrating attachment of the sheet ejection roller to the sheet ejection section according to Embodiment 1.

Referring to FIGS. 10A, 10B, and 11, configurations of the sheet ejection roller 1301 and the roller holder 1302 are described below.

FIGS. 10A and 10B illustrate attachment of the sheet ejection roller 1301, which makes corrugation, to the roller holder 1302. The sheet ejection roller 1301, together with a pressure spring, is attached to the roller holder 1302. Hereinafter an ejection roller assembly 1603 refers to the assembly including the sheet ejection roller 1301, the pressure spring, and the roller holder 1302. The sheet ejection roller 1301 is supported by the roller holder 1302. As illustrated in FIG. 4, the ejection roller assembly 1603 is removably attached to the ejection guide plate 1303 of the image forming apparatus 1.

Figure 12:
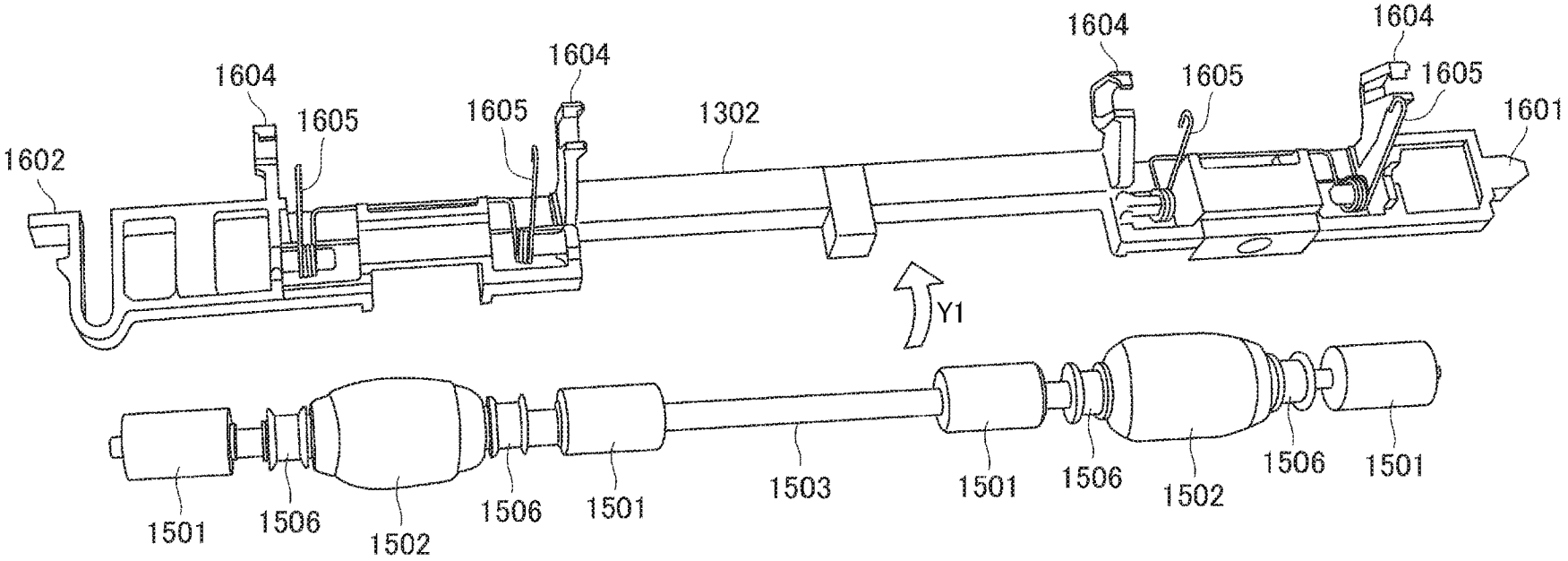
FIG. 12 is a perspective view illustrating attachment of the sheet ejection roller to the roller holder according to Embodiment 1.

The roller holder 1302 includes a projection 1601, a lever 1602, bearing hooks 1604, and the spring 1605 (illustrated in FIG. 12). The projection 1601 fits in an engaging portion 1303*a* disposed on a first end (on the left in FIGS. 10A, 10B, and 11) of the ejection guide plate 1303. The lever 1602 fits in an engaging portion 1303*b* disposed on a second end (on the right in FIGS. 10A and 11) of the ejection guide plate 1303. Each of the engaging portions 1303*a* and 1303*b* can be an insertion hole or recess. When the lever 1602 is inserted in the engaging portion 1303*b*, the ejection roller assembly 1603 is secured to the sheet ejection section 1300.

The bearing hooks 1604 engage the shaft 1503 of the sheet ejection roller 1301 when the sheet ejection roller 1301 is attached to the roller holder 1302. The springs 1605 contact or abut against the respective spring-receiving roller bodies 1506, giving the biasing force to the sheet ejection roller 1301, when the sheet ejection roller 1301 is attached to the roller holder 1302. In the present embodiment, the roller holder 1302 is made of polyoxymethylene (POM, or polyacetal) resin, for example.

As illustrated in FIG. 11, the projection 1601 is inserted in the engaging portion 1303*a* at the first end of the ejection guide plate 1303. Subsequently, the lever 1602 is inserted in the engaging portion 1303*b* at the second end of the ejection guide plate 1303, thereby securing the ejection roller assembly 1603 to the sheet ejection section 1300.

The sheet ejection roller 1301 is assembled in the following procedure. The roller bodies 1501 and the roller bodies 1502 are attached, by press fitting, to the shaft 1503, and the spring-receiving roller bodies 1506 are loosely fit with play to the shaft 1503. After the roller bodies 1501 and the roller bodies 1502 are press-fitted to the shaft 1503, the paired spring-receiving roller bodies 1506 on both sides of the spring-receiving roller body 1506 are attached by thrust stop. Thus, the positions of the roller bodies 1501, the roller bodies 1502, and the spring-receiving roller bodies 1506 are determined relative to the shaft 1503. Since the sheet ejection roller 1301 is assembled into a single component, attachment and removal of the sheet ejection roller 1301 to and from the roller holder 1302 is easy. In another embodiment, the image forming apparatus is provided with multiple different types of sheet ejection rollers 1301 different in shape (or diameter) of the roller bodies 1501 and the roller bodies 1502 so that the sheet ejection roller 1301 is replaced in accordance with the need for corrugation.

Figure 13:
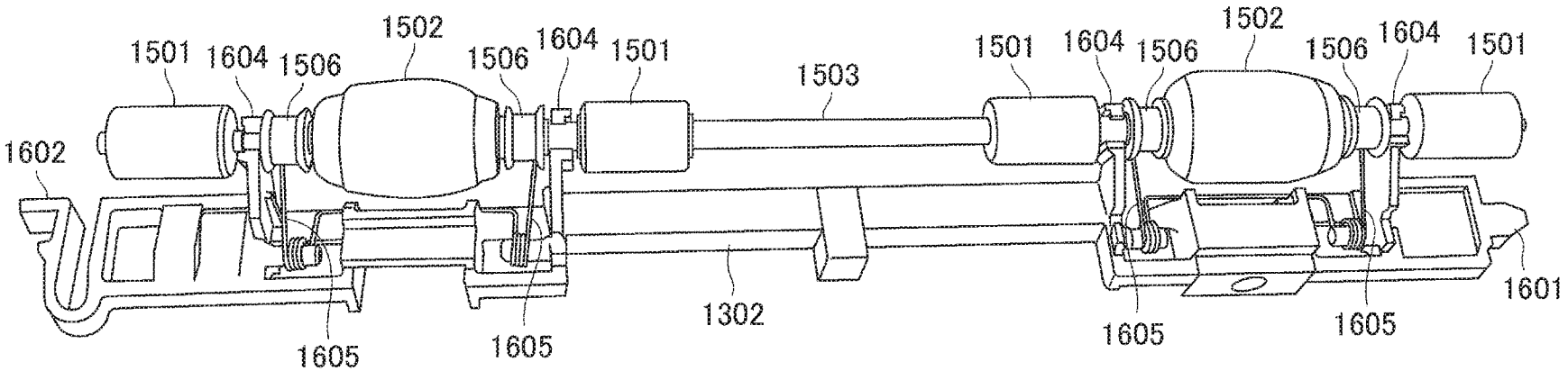
FIG. 13 is a perspective view illustrating attachment of the sheet ejection roller to the roller holder according to Embodiment 1.

Referring to FIGS. 12 and 13, an attachment procedure of the sheet ejection roller 1301 to the roller holder 1302 is described below. FIGS. 12 and 13 illustrate the sheet ejection roller 1301 and the roller holder 1302 from a side different from that in FIGS. 10A and 10B. From the state illustrated in FIG. 12, the spring-receiving roller bodies 1506 of the sheet ejection roller 1301 are brought into contact with the respective springs 1605 and pushed in the direction indicated by arrow Y1 illustrated in FIG. 12. The sheet ejection roller 1301 is pushed in the direction indicated by arrow Y1 to the position where the shaft 1503 engages the bearing hooks 1604. To remove the sheet ejection roller 1301 from the roller holder 1302, the procedure described above is performed in reverse.

Figure 14:
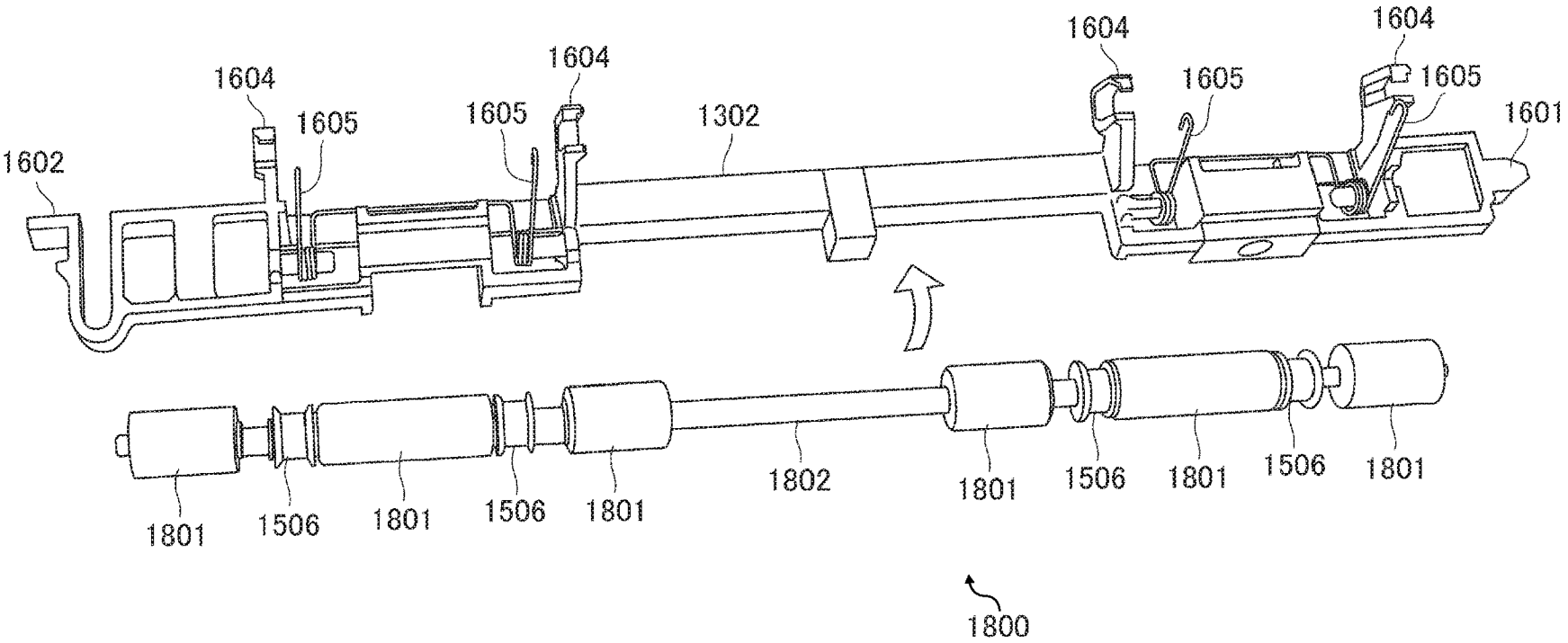
FIG. 14 is a perspective view illustrating attachment of the sheet ejection roller to the roller holder according to Embodiment 1.
Figure 15:
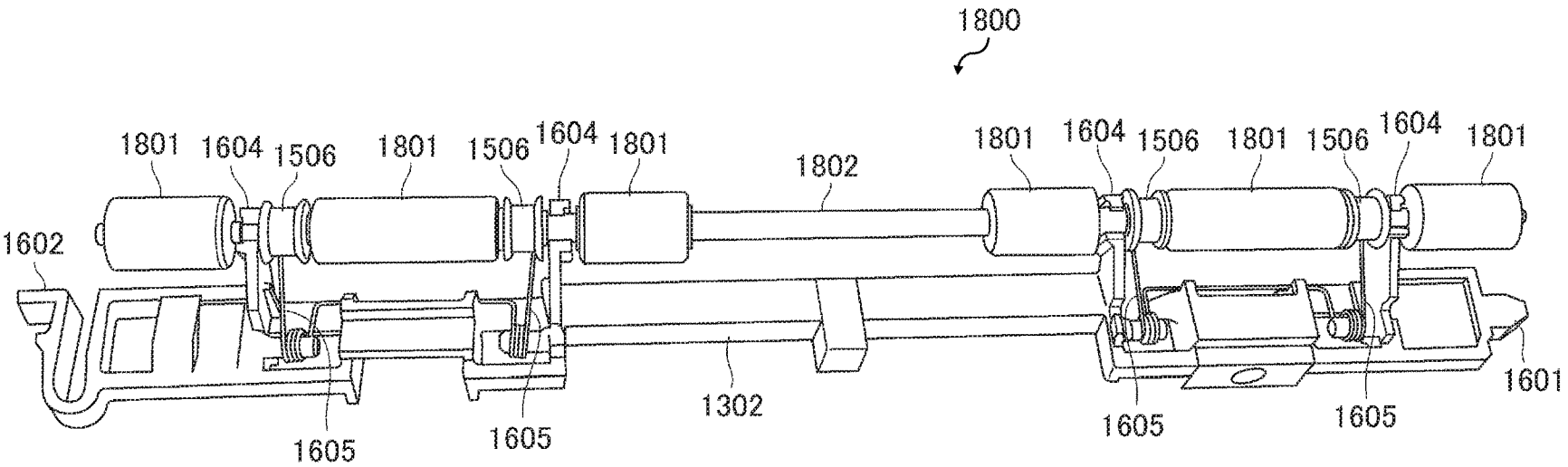
FIG. 15 is a perspective view illustrating attachment of the sheet ejection roller to the roller holder according to Embodiment 1.

FIGS. 14 and 15 illustrate attachment of the sheet ejection roller 1800, which does not make corrugation, to the roller holder 1302. The procedure of attachment of the sheet ejection roller 1800 is similar to the procedure described with reference to FIGS. 12 and 13.

Figure 16:
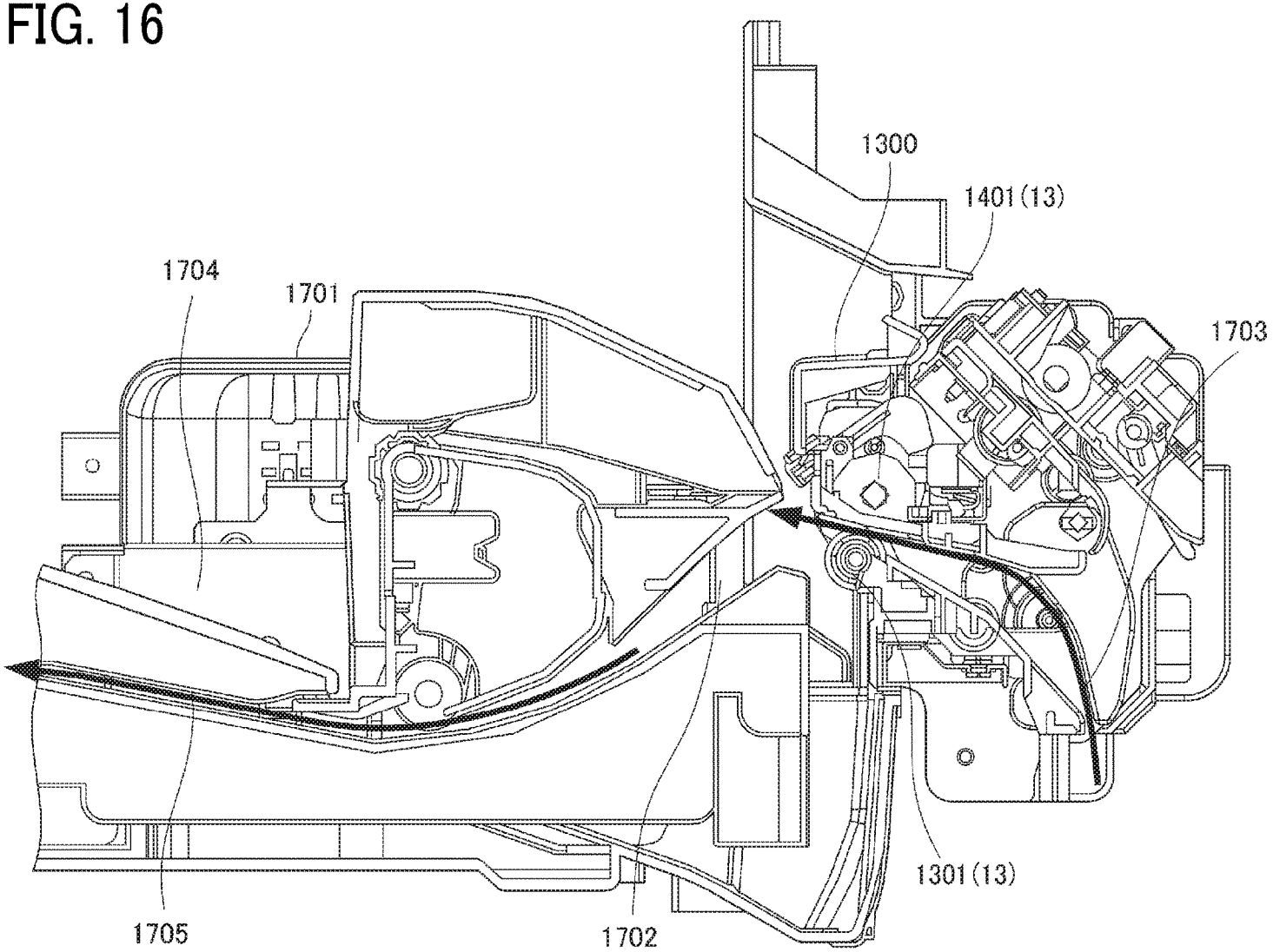
FIG. 16 is a cross-sectional view illustrating a state in which a relay unit is coupled to the image forming apparatus according to Embodiment 1.

FIG. 16 illustrates a state in which the sheet ejection roller 1301 is mounted in the sheet ejection section 1300 and the relay unit 1701 is mounted in a housing-internal space 1704. The relay unit 1701 includes a sheet conveyance path that branching into the housing-internal space 1704 and a conveyance path 1705 leading to the sheet processing apparatus 1900. The relay unit 1701 is removably attached to the sheet ejection section 1300.

Figure 17:
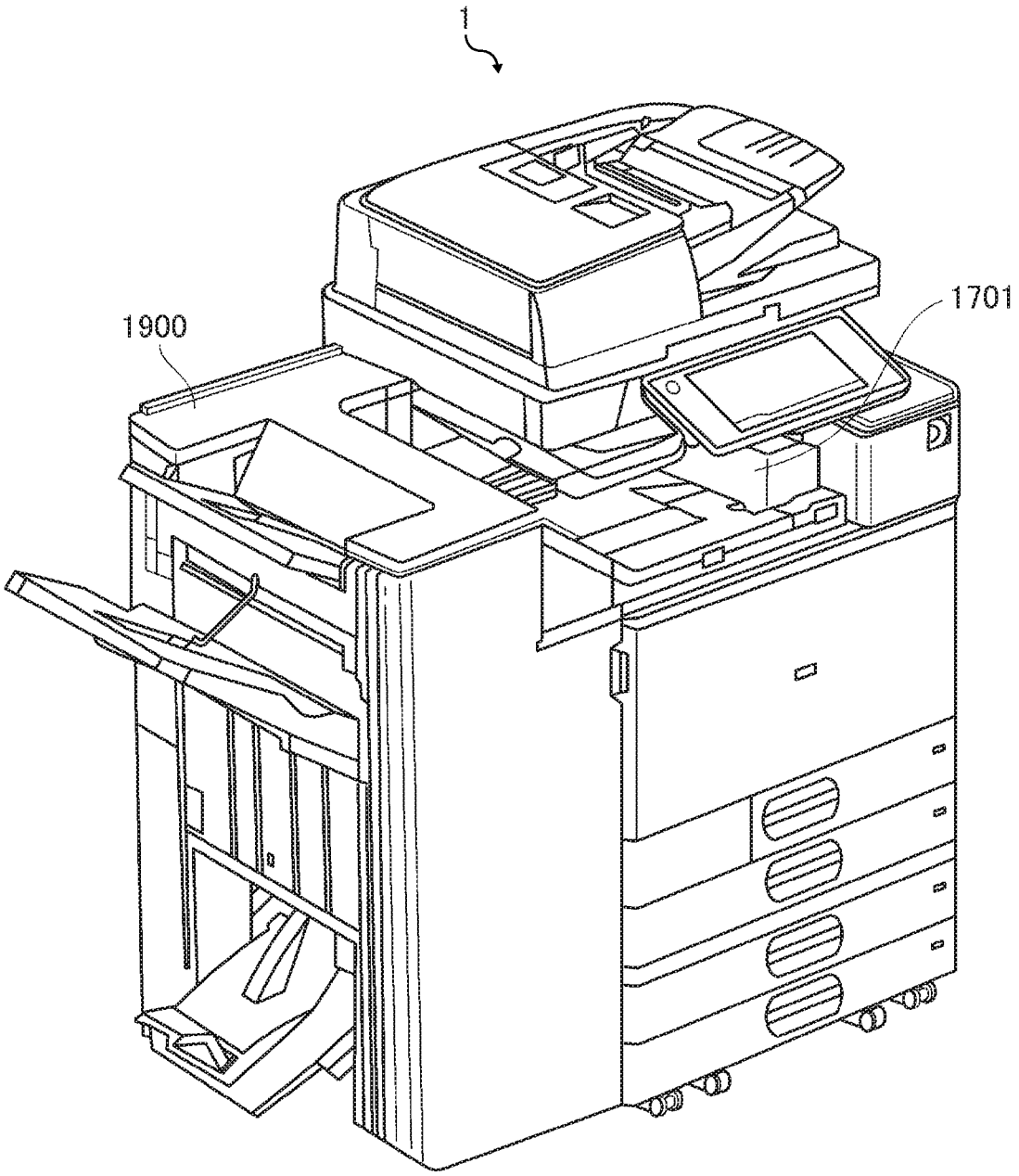
FIG. 17 is a perspective view illustrating a state in which the relay unit and a sheet processing apparatus are coupled to the image forming apparatus according to Embodiment 1.

FIG. 17 illustrates a state in which the relay unit 1701 and the sheet processing apparatus 1900 are coupled to the image forming apparatus 1. The relay unit 1701 is designed to feed the sheet P ejected from the sheet ejection section 1300 to the sheet processing apparatus 1900. The sheet processing apparatus 1900 includes various types of sheet processing devices to process the sheet P transported via the relay unit 1701. The various types of sheet processing devices include a side stapler and a saddle stapler, for example.

Figure 18:
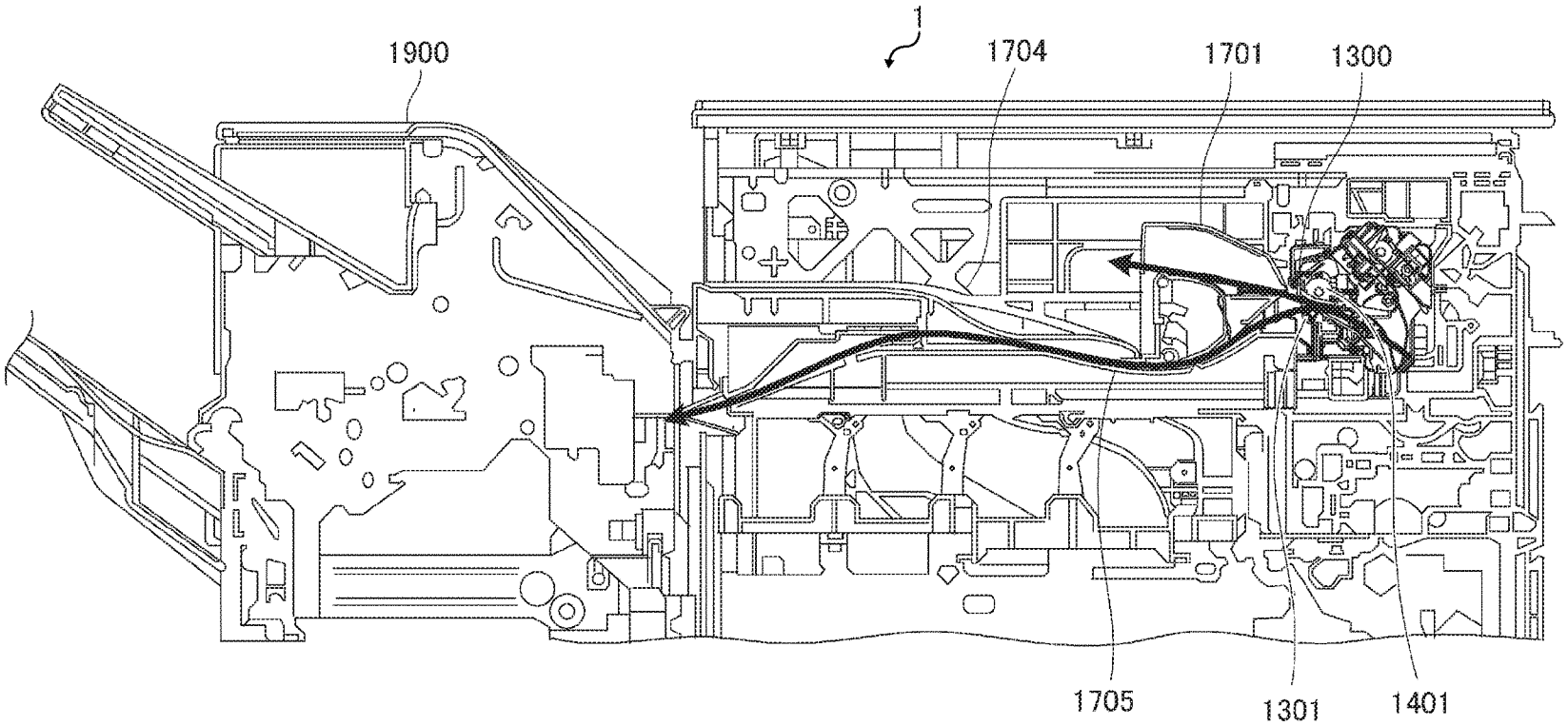
FIG. 18 is a cross-sectional view illustrating a state in which the relay unit and the sheet processing apparatus are coupled to the image forming apparatus according to Embodiment 1.

FIG. 18 is a cross-sectional view illustrating sheet conveyance paths in the state in which the relay unit 1701 and the sheet processing apparatus 1900 are coupled to the image forming apparatus 1.

Through the sheet ejection path 1703 (illustrated in FIG. 16) inside the sheet ejection section 1300, the sheet P bearing the fixed toner image is forwarded via the ejection roller pair 13 to the relay unit 1701. Since a conveyance guide for sheet reversing is disposed vertically above the relay unit 1701, it is preferable that the housing-internal space 1704 has a sufficient height (space above the output tray 14) to increase the number of stackable sheets and facilitate removal of sheets from the output tray 14. Accordingly, a conveyance guide 1702 in the relay unit 1701 has an inclined face inclined down, and the conveyance path 1705 inside the relay unit 1701 includes a downward path.

In the configuration illustrated in FIGS. 16 through 18, the leading end of the sheet P that has passed through the ejection roller pair 13 contacts the conveyance guide 1702 at a relatively large angle. Accordingly, in the case where corrugation is made on the sheet P and the sheet P has stiffness, there is a disadvantage that the possibility of defective conveyance is higher.

To avoid this disadvantage, in the sheet ejection section 1300 illustrated in FIG. 18, the sheet ejection roller 1800, which does not make corrugation, is used. With this configuration, corrugation is not made on the sheet P, thereby inhibiting the defective conveyance resulting from the stiffness of the sheet P.

Figure 19:
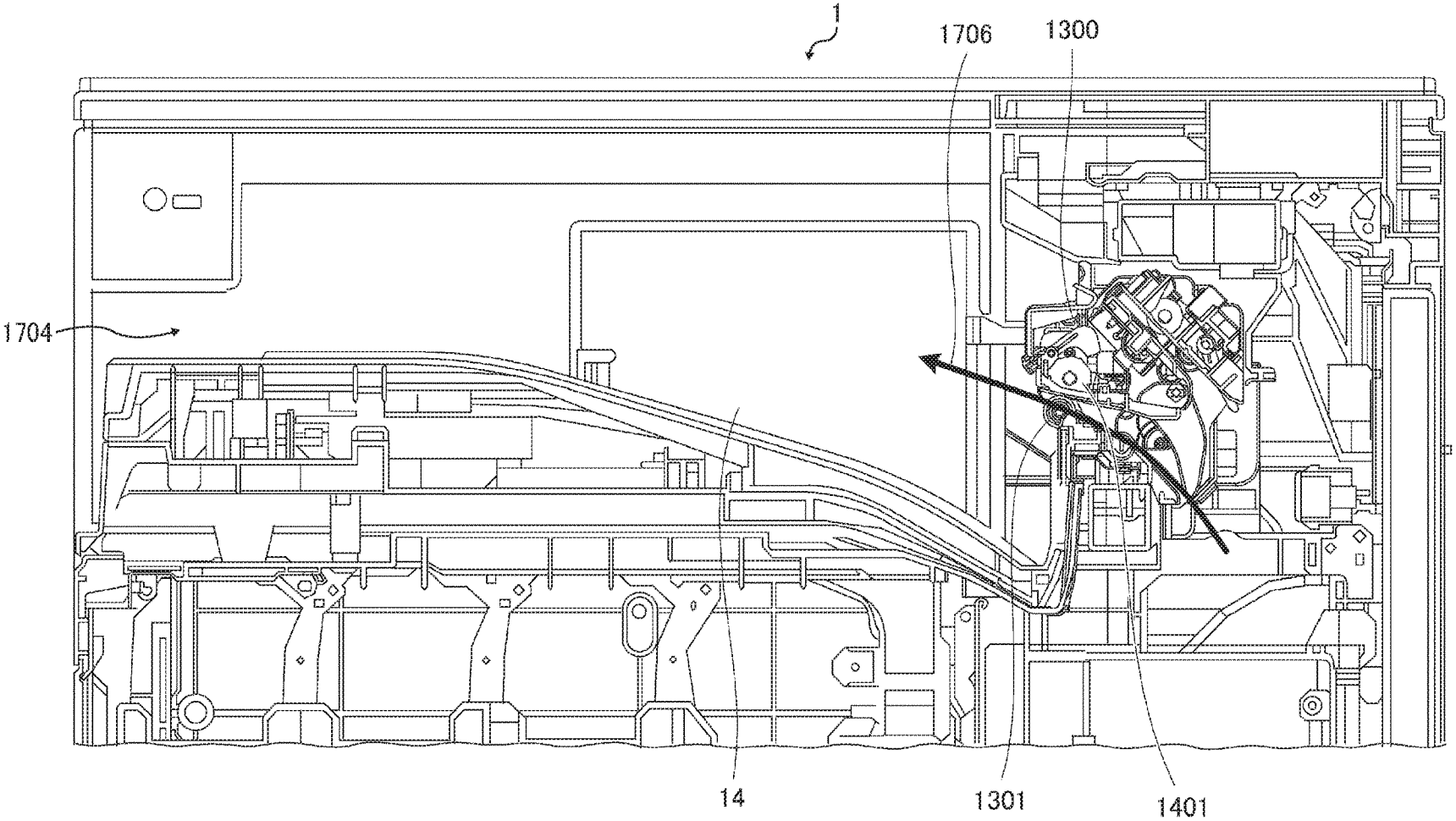
FIG. 19 is a cross-sectional illustrating a state in which an output tray is mounted in the image forming apparatus according to Embodiment 1.

FIG. 19 illustrates the image forming apparatus 1 to which neither the sheet processing apparatus 1900 nor the relay unit 1701 is coupled. In FIG. 19, the output tray 14 is disposed in the housing-internal space 1704, and the route through which the sheet P is ejected from the sheet ejection section 1300 is different from that illustrated in FIG. 18.

As illustrated in FIG. 19, the sheet P is ejected from the sheet ejection section 1300 though a sheet ejection path 1706 onto the output tray 14. At that time, the sheet P draws a smooth curve. The sheet ejection path 1706 does not includes a steep curve differently from the route including the sheet ejection path 1703 and the conveyance path 1705 illustrated in FIG. 16. Accordingly, even if the sheet P has stiffness, the stiffness does not result in the defective conveyance.

Accordingly, in the sheet ejection section 1300 illustrated in FIG. 19 employing the sheet ejection roller 1301 for corrugation, winding and curl of the sheet P can be removed, and the defective conveyance resulting from the stiffness of the sheet P is inhibited. Thus, in the present embodiment, the sheet ejection roller type is changed in accordance with the conveyance route of the sheet P ejected from the sheet ejection section 1300. Although the two types of sheet ejection rollers, namely, the sheet ejection rollers 1301 and 1800, are described above, the sheet ejection roller type is not limited thereto.

As described above, in the image forming apparatus 1 according to the present embodiment, the sheet ejection roller 1301 is removably mounted in the sheet ejection section 1300 via the roller holder 1302, and the sheet ejection roller 1301 includes the shaft 1503 and the roller bodies 1501 and 1502, which are united into a single component. Additionally, the relay unit 1701 can be removably coupled to the sheet ejection section 1300, and the sheet ejection roller 1301, the sheet ejection roller 1800, and the roller holder 1302 are replaceable in accordance with the route of the sheet P ejected from the sheet ejection section 1300.

With this configuration, whether to make corrugation and the degree of stiffness given to the sheet P can be changed easily with the sheet ejection roller type. By replacing a part (the sheet ejection roller 1301 and the sheet ejection roller 1800) of components, sheet stiffness setting can be made in accordance with whether or not the relay unit 1701 and the sheet processing apparatus 1900 are coupled to the image forming apparatus 1. By selecting a proper stiffness setting, detective sheet conveyance can be avoided in the route downstream from the sheet ejection section 1300.

In a case where the sheet processing apparatus 1900 is coupled to the image forming apparatus 1 during installation of the apparatus, removing and attaching frequency thereof is low. Accordingly, even in the configuration in which the sheet ejection rollers 1301 and 1800 are replaceable, the functions are carried out sufficiently, and automatic switching is unnecessary. Therefore, a space for the sheet ejection roller 1301 or 1800 to move is unnecessary, which contributes to reduction in space and cost.

Since the sheet stiffening setting can be changed by replacing the sheet ejection rollers 1301 and 1800, the relay unit 1701 has a higher degree of design flexibility in layout of the sheet conveyance path.

Additionally, the roller bodies and the shaft is united in each of the sheet ejection rollers 1301 and 1800, and the sheet stiffening setting can be changed by replacing one component (the sheet ejection roller 1301 or 1800 as a whole). This configuration facilitates removal and mounting of the sheet ejection rollers 1301 and 1800 and the roller holder 1302.

Additionally, the image forming apparatus 1 can include the output tray 14 to receive the sheets P ejected from the sheet ejection section 1300.

Alternatively, the relay unit 1701 is coupled to the sheet ejection section 1300, and the sheet processing apparatus 1900 is coupled to the relay unit 1701. In this configuration, various types of sheet processing can be made on the sheet P ejected from the sheet ejection section 1300.

Additionally, the sheet conveyance route inside the relay unit 1701 can include the conveyance path 1705 inclined down. With this configuration, the housing-internal space 1704 has a sufficient height to increase the number of stackable sheets and facilitate operability in sheet removal.

Additionally, the sheet ejection section 1300 can be provided with the sheet ejection roller 1800 having the multiple roller bodies similar in diameter. In this configuration, the sheet P passing through the sheet ejection section 1300 is not stiffened, and this configuration is used when sheet stiffening is unnecessary.

Additionally, the multiple roller bodies of the sheet ejection roller 1301 can be different in diameter. In this configuration, the sheet P passing through the sheet ejection section 1300 is stiffened by corrugation, and this configuration is used when sheet stiffening is necessary.

Embodiment 1 described above concerns changing the sheet stiffening setting in accordance with the conveyance route of the sheet P ejected from the sheet ejection section 1300. Curls of sheets, however, generally arise in fixing devices. It is conceivable to correct the curl immediately after the fixing.

More specifically, fixing devices used in electrophotographic image forming apparatuses fix toner images on recording sheets with heat and pressure applied to the fixing nip. That is, fixing devices includes a heating-side component (e.g., a heating roller or a heating belt) and a pressing-side component (e.g., a pressure roller or a pressure belt). At that time, due to the difference in temperature between the heading side and the pressing side, vapor evaporation by heating becomes uneven. Consequently, the sheet is curled. Curled sheets can get stuck in the conveyance path and a connection between the image forming apparatus and the sheet processing apparatus (or a finisher), causing defective conveyance. Curled sheets also can inhibit alignment of sheets.

To address such inconveniences, there are curl correction structures (i.e., decurlers). For example, a decurler includes a curling guide to forcibly curl sheets in the direction opposite the direction in which the sheet is curled by the fixing device. In such a configuration, when thick sheets are fed, for example, there are following three disadvantages.

(1) Since back curl, meaning curling of the sheet to the back side of the sheet, does not occur on thick sheets in the fixing device, when the curling guide is constantly at the position to forcibly curl the sheet, the thick sheet can have face curl, meaning curling of the sheet to the front side of the sheet.

(2) Since the curling guides presses the sheet with a strong force, the back side of the sheet suffers a damage such as scratches and abrasion caused by the guide.

(3) When the sheet exits the conveyance roller pair and the leading end of the sheet contacts the curling guide, due to a high stiffness of the sheet, the leading end is bent, degrading sheet feeding reliability.

In the image forming apparatus according to Embodiment 2 described below, decurling is turned on and off (e.g., the position of the guide 205 is switched) in accordance with sheet type and sheet stiffening setting in the sheet ejection section 1300, thereby inhibiting defective conveyance due to the decurling.

Embodiment 2

An image forming apparatus according to Embodiment 2 is described below.

Elements of the image forming apparatus according to Embodiment 2 identical or similar to those of Embodiment 1 are given identical or similar reference numerals indicated in FIGS. 1 and 19, and differences from Embodiment 1 are described mainly below.

The basic structure of the image forming apparatus according to Embodiment 2 is similar to the structure illustrated in FIG. 1, and descriptions thereof are omitted or simplified to avoid redundancy.

Figure 20:
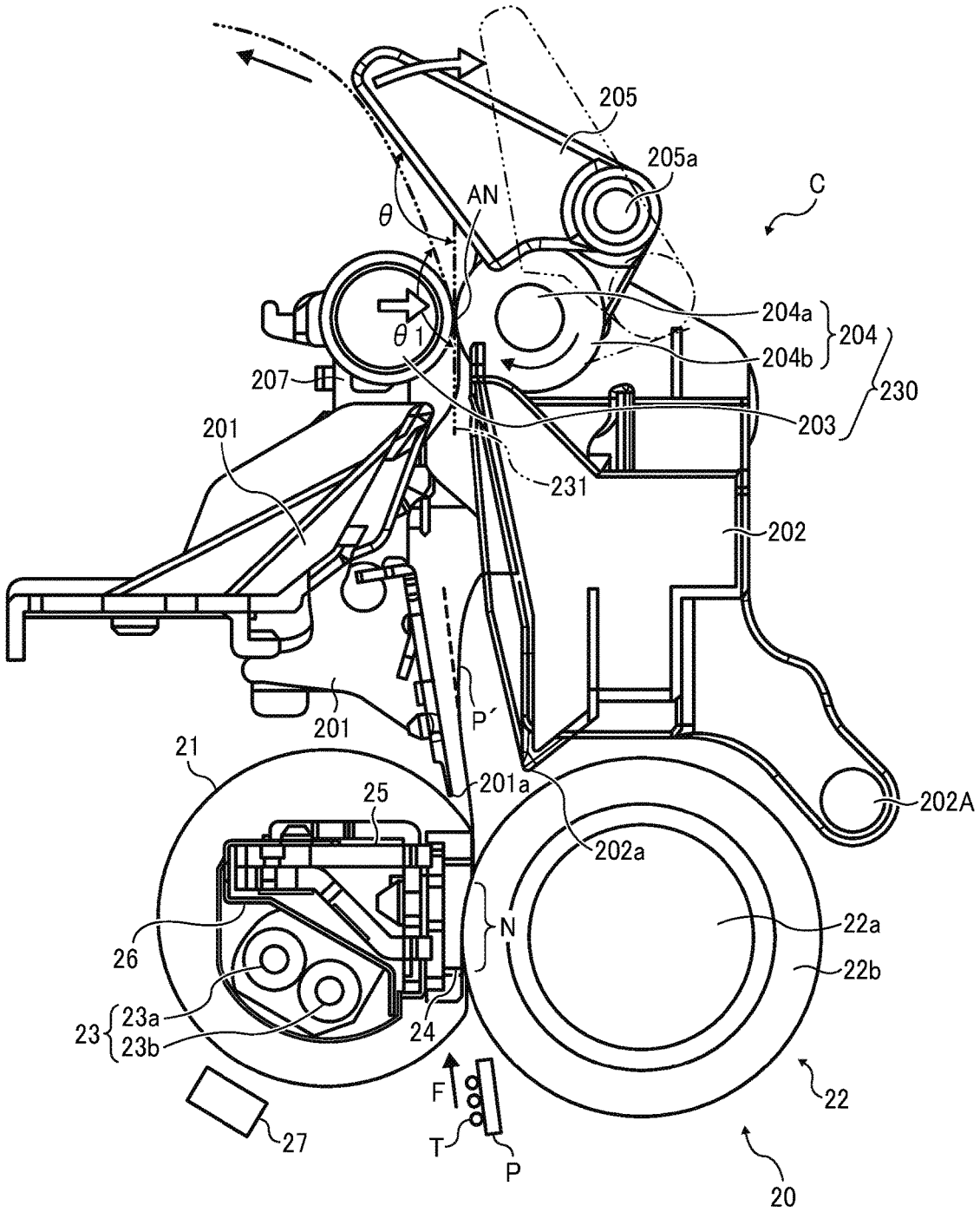
FIG. 20 is a cross-sectional view of a guide according to Embodiment 2, being at a first position.
Figure 21:
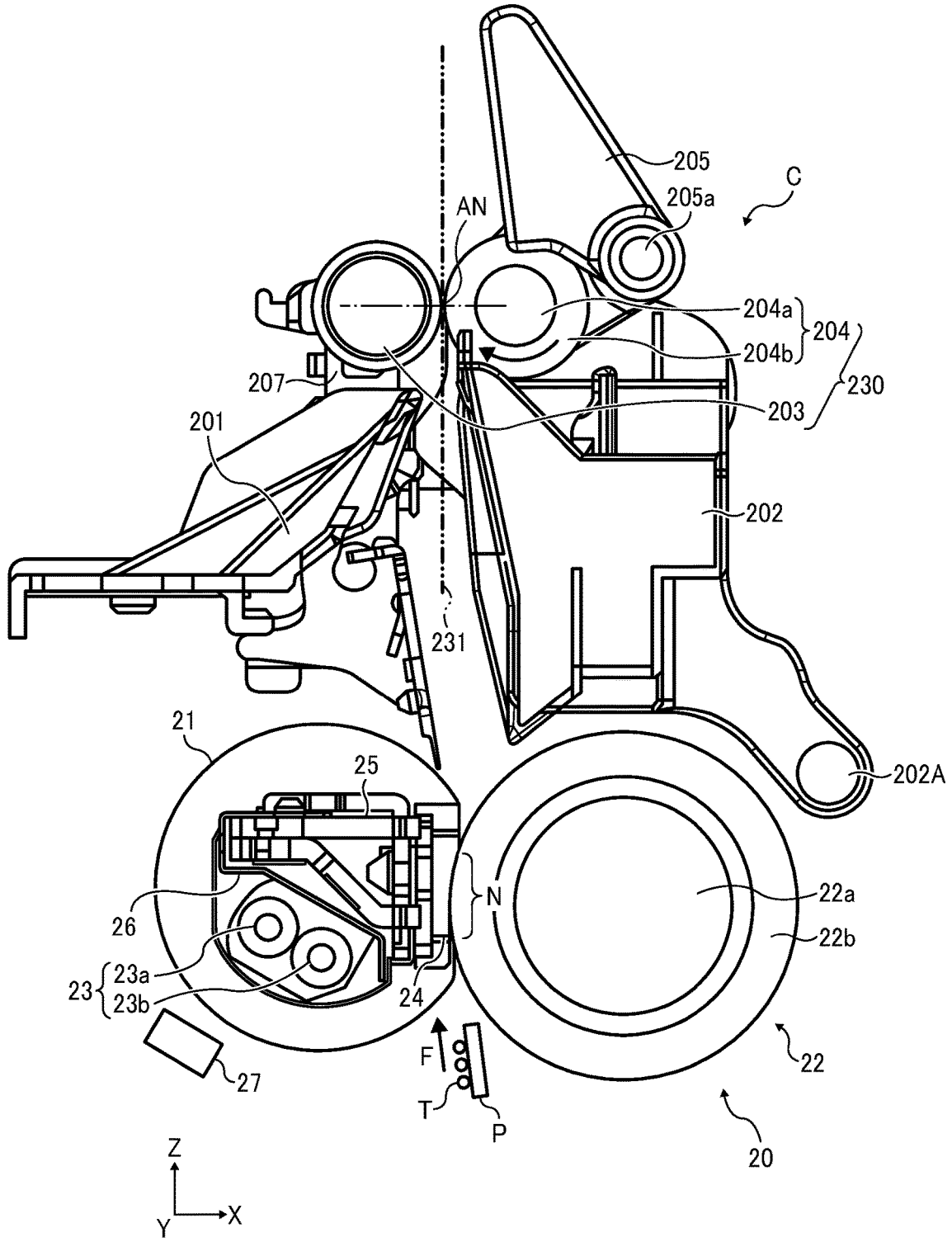
FIG. 21 is a cross-sectional view of the guide according to Embodiment 2, being at a second position.

With reference to FIGS. 20 and 21, the position of the guide 205 is described. The guide 205 is disposed immediately downstream from the conveyance-assist roller pair 230 in the sheet conveyance direction. The guide 205 guides the sheet P discharged from the conveyance-assist roller pair 230. The guide 205 is movable between a first position illustrated in FIG. 20 and a second position illustrated in FIG. 21.

In FIG. 20, the sheet P ejected from the conveyance-assist roller pair 230 moves along a route 231 passing through the auxiliary nip AN, and the route 231 is at right angles to a line connecting centers of the driving roller 204 and the driven roller 203. Being at the first position, the guide 205 blocks the route 231 of the sheet P ejected from the conveyance-assist roller pair 230. Thus, the leading end of the sheet P conveyed in the direction indicated by arrow F contacts the guide 205 at a contact angle θ. Then, the conveyance-assist roller pair 230 conveys the sheet P while pressing the sheet P against the guide 205. Thus, the guide 205 change the direction in which the sheet P ejected from the conveyance-assist roller pair 230 is conveyed.

As illustrated in FIG. 20, the guide 205 curves the sheet P to the front side carrying a toner image T. As a result, the guide 205 guides the sheet P at an angle θ1 relative to the route 231, with the auxiliary nip AN serving as a starting point, thereby bending the sheet P to the side opposite the back curl. With the conveyance path designed as described above, after the sheet P exits the guide 205, the sheet P is ejected outside the image forming apparatus 1 with the back curl caused in the fixing nip N ameliorated. Thus, the guide 205 performs decurling.

However, in the configuration in which the guide 205 being the first position actively contacts the back side of the sheet P, a large conveyance resistance acts on the back side of the sheet P, applying stress on the sheet P. Accordingly, in the case of thick sheets greater in stiffness, it is possible that the contract with the guide 205 leaves a mark on the thick sheet P, or the guide 205 is abraded.

In image formation on the second side of the sheet P in duplex printing, since the guide 205 contacts the first side on which the image is formed, it is highly possible that the image is rubbed and gloss becomes streaky. In particular, while the fixing device 20 fixes the image on the second side, the first side, carrying the fixed image and serving as the back side at that time, is again heated in the fixing nip N. When the heated first side is strongly rubbed by the guide 205, toner tends to be peeled off and the gloss level changes.

By contrast, in FIG. 21, the guide 205 is at the second position and withdrawn from the route to inhibit the guide 205 from actively contacting the sheet P. In this case, although the back curl is not corrected, there is no stress on the sheet P, thus preventing scratches on the back side of the sheet P, abrasion, image rubbing, and streaky gloss.

Since curl correction (decurling) and image rubbing prevention are not balanced with an identical position of the guide 205, the image forming apparatus 1 according to the present embodiment further includes a mechanism to move the guide 205 between the first position illustrated in FIG. 20 and the second position illustrated in FIG. 21 depending on the sheet feeding condition (or sheet conveyance mode) described later. Specifically, at least one of the guide 205 and the divider 15 is moved to cope with each sheet feeding condition.

Figure 22A:
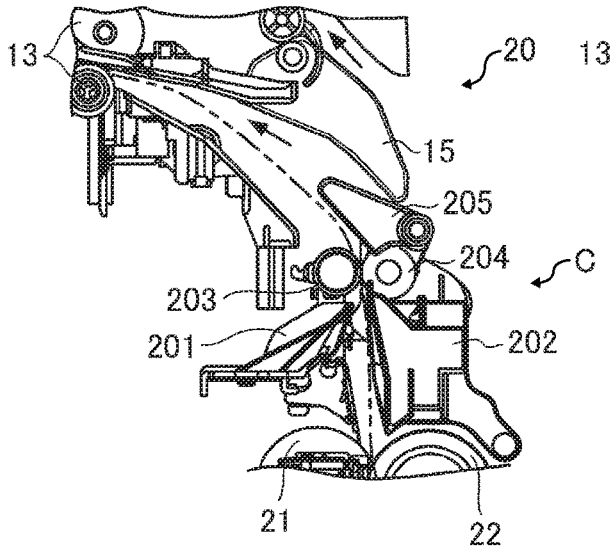
FIGS. 22A through 22D are cross-sectional views illustrating positions of the guide and a divider according to Embodiment 2, in accordance with different sheet conveyance modes.

In single-side printing, when the sheet thickness is not greater than a threshold thickness value (e.g., weight per square meters or basis weight), the guide 205 and the divider are disposed at the positions illustrated in FIG. 22A. That is, the guide 205 is at the first position. When the sheet P is not thick, it is not necessary to consider the friction with the guide 205, and it is not necessary to feed the sheet P to the reversing path 17A in single-side printing.

Figure 22B:
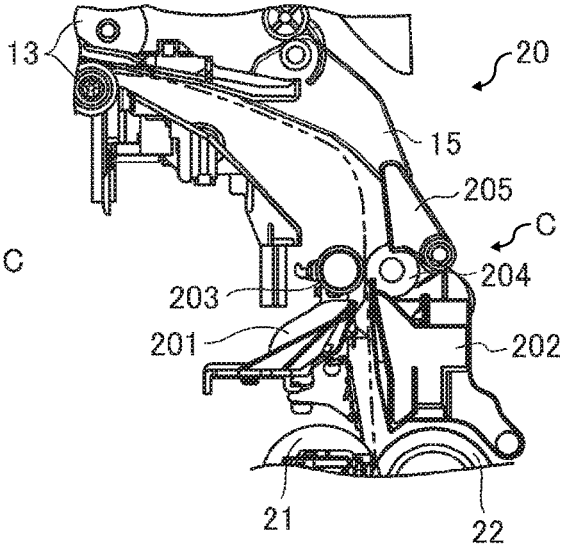

By contrast, when the sheet thickness is greater than the threshold thickness in single-side printing, the guide 205 and the divider 15 are disposed at the positions illustrated in FIG. 22B. That is, the guide 205 is at the second position. When the sheet P is thick, it is preferred to consider the friction with the guide 205. In the present embodiment, the threshold thickness value is 160 g/m$^2$, but the threshold thickness value is not limited thereto. For example, a greater weight per square meter is used to increase the thickness range of sheets subjected to curl correction.

In duplex printing, the guide 205 is disposed at the second position (i.e., an open position) in both of image formation on the first side and that on the second side, and the divider 15 is switched between first and second positions to switch the route of the sheet P between the route to eject the sheet P and the reversing path 17A.

Figure 22C:
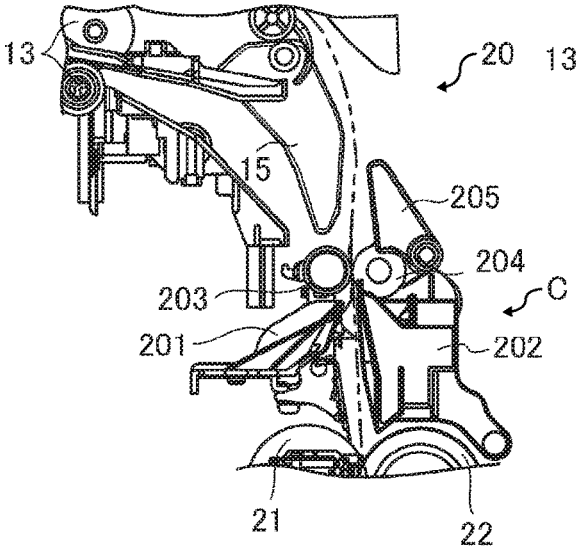

Specifically, in image formation on the first side in duplex printing, the guide 205 and the divider 15 are moved to the positions illustrated in FIG. 22C so that the guide 205 does not contact the sheet P guided to the reversing path 17A. That is, the guide 205 is at the second position, and the divider 15 is at the second position (closed).

Figure 22D:
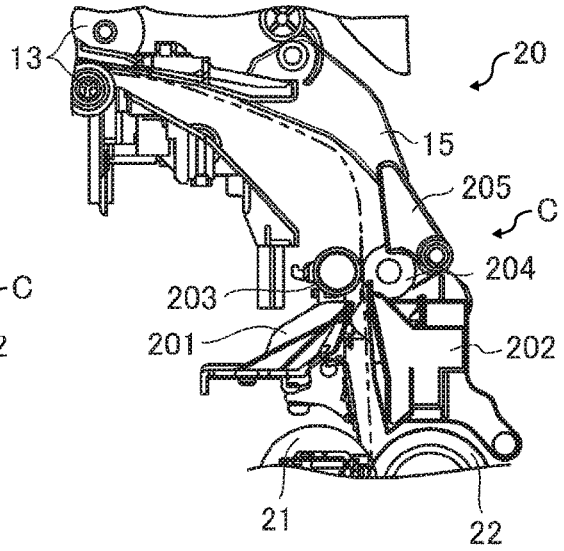

In image formation on the second side in duplex printing, the guide 205 and the divider 15 are moved to the positions illustrated in FIG. 22D so that the guide 205 does not contact the sheet P guided to the route to eject the sheet P. That is, the guide 205 is at the second position, and the divider 15 is at the first position (open).

The positions of the guide 205 and the divider 15 can be switched depending on sheet type in addition to the sheet feeding condition (or sheet feeding route) and sheet thickness. For example, the guide 205 is disposed at the first position when recycled paper, which easily curls, is used. The guide 205 is disposed at the second position when glossy paper is used.

Additionally, the positions of the guide 205 and the divider 15 can be switched in accordance with the ejection roller type. For example, when the sheet ejection roller 1301 capable of corrugation is used, the guide 205 is disposed at the second position not to execute decurling. When the sheet ejection roller 1800 that does not make corrugation is used, the guide 205 is disposed at the first position to execute decurling.

The information set via the display 152 illustrated in FIG. 2, such as printing menu (single-side printing or duplex printing), sheet thickness, and sheet type, is used in determining the sheet conveyance condition. Thus, the display 152 serves as an input device.

With reference to FIGS. 23 through 29, descriptions are given below of the guide 205 and the mechanism to move the guide 205.

Figure 23:
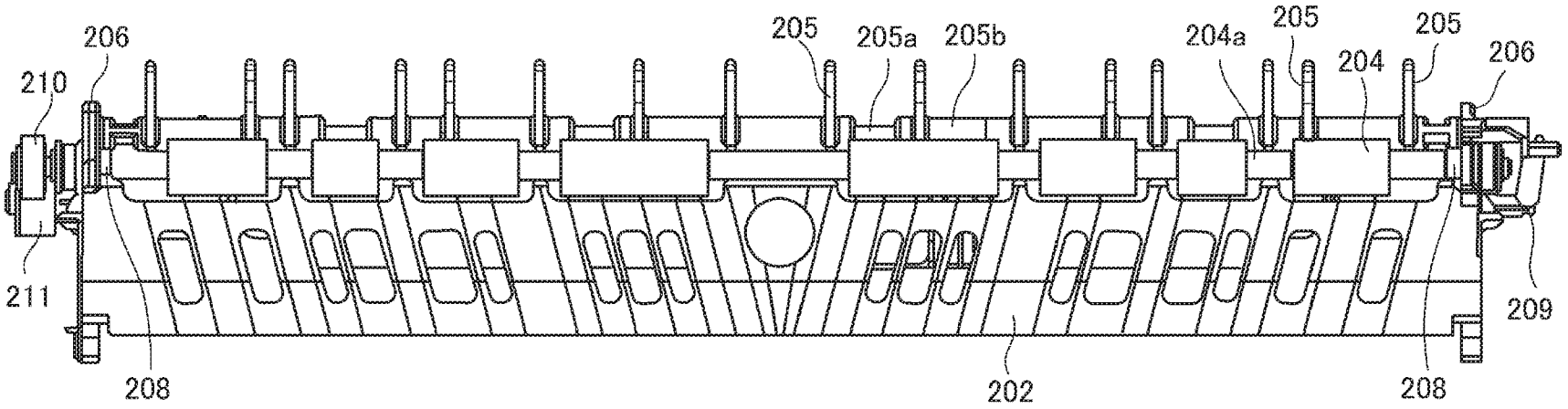
FIG. 23 illustrates a pressure-side separator according to Embodiment 2.

FIG. 23 illustrates the pressure-side separator 202 as viewed from a sheet conveying face. The driving roller 204 of the conveyance-assist roller pair 230 is rotatably supported via plain bearings 208 by both ends of the pressure-side separator 202. The driving force from a driving source is transmitted via an idler gear 211 to a driving gear 210 disposed on the roller shaft (i.e., the metal core 204*a*), so that the driving roller 204 rotates.

The guide 205 is disposed downstream from the driving roller 204 and supported via the plain bearings 208 at both ends of the driving roller 204 by the pressure-side separator 202. Thus, the guide 205 is supported by an identical shaft that supports the driving roller 204, and the guide 205 rotates around the axis of rotation of the driving roller 204. It is to be noted that the driving roller 204 rotates while being contact with an inner diameter portion of the plain bearings 208, and the guide 205 rotates while being in contact with an outer diameter portion of the plain bearings 208.

In this configuration, regarding the gap between the driving roller 204 and the guide 205, cumulative dimensional tolerance of parts is minimized, and the dimensional tolerance includes only the tolerance in radial distance from the axial center of each part. Accordingly, the guide 205 is movable with the gap between the driving roller 204 and the guide 205 kept constant with high precision.

As illustrated in FIGS. 22A through 22D, the guide 205 and the divider 15 downstream therefrom are independently movable depending on the sheet conveyance condition (sheet conveyance mode). Accordingly, it is preferred that the guide 205 and the divider 15 do not interfere with each other even if overlapping each other, as viewed in the eye-view direction in FIGS. 22A through 22D.

Figure 29:
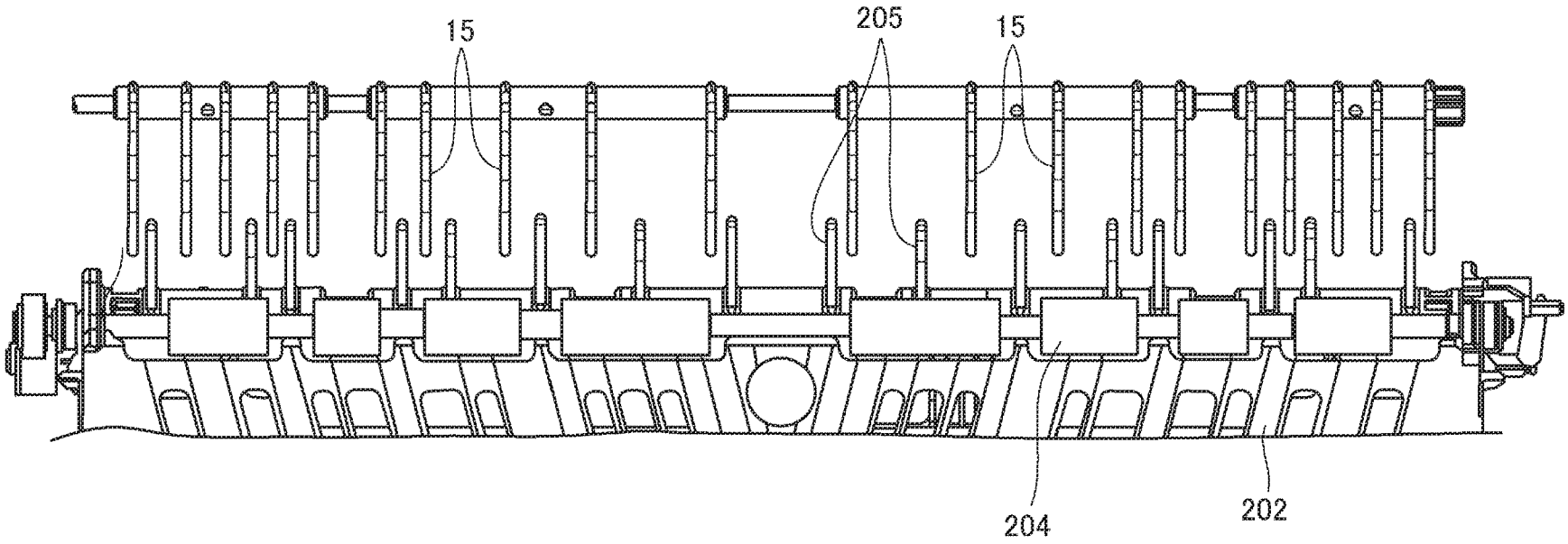
FIG. 29 illustrates relative positions of the guide and the divider according to Embodiment 2.

Therefore, each of the guide 205 and the divider 15 includes multiple claw-like ribs arranged in the longitudinal direction of the curl correction structure C or the driving roller 204. As illustrated in FIG. 29, the guide 205 is disposed so that each claw-like rib thereof is interposed between adjacent claw-like ribs of the divider 15 (or outside the ribs of the divider 15) in the longitudinal direction. Thus, the guide 205 and the divider 15 can move independently of each other even if overlapping each other.

Figure 24A:
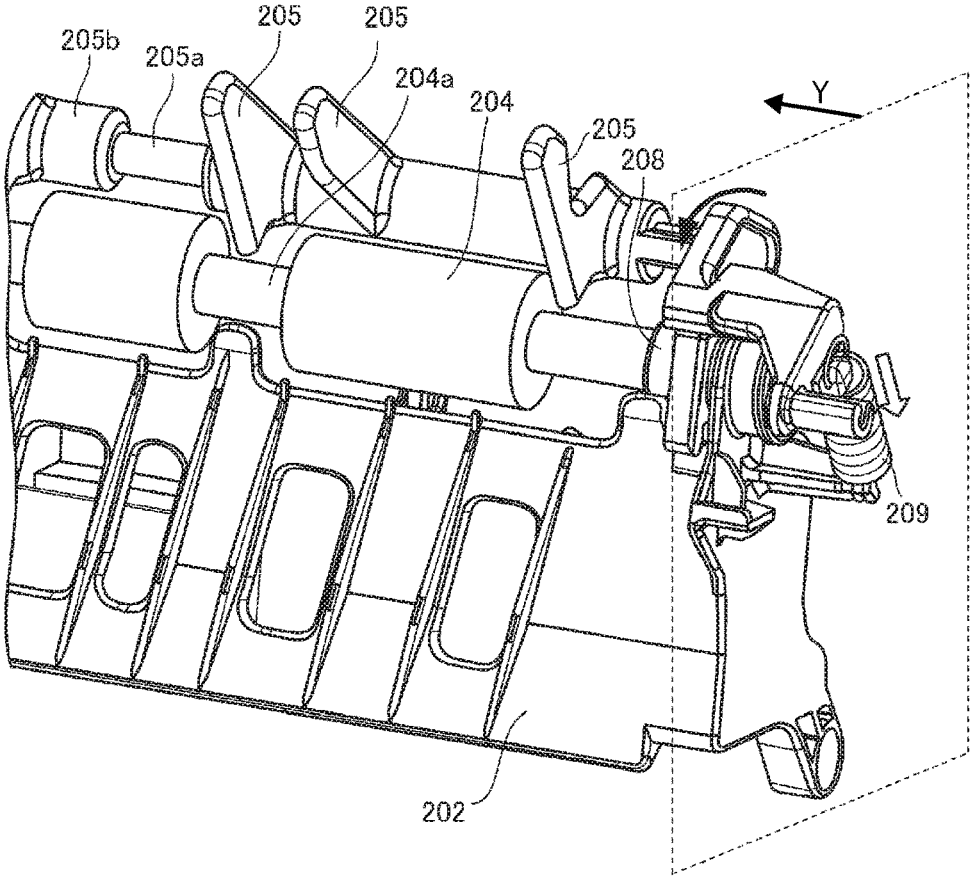
FIGS. 24A and 24B illustrate relative positions of the guide and a conveyance-assist roller pair according to Embodiment 2.
Figure 24B:
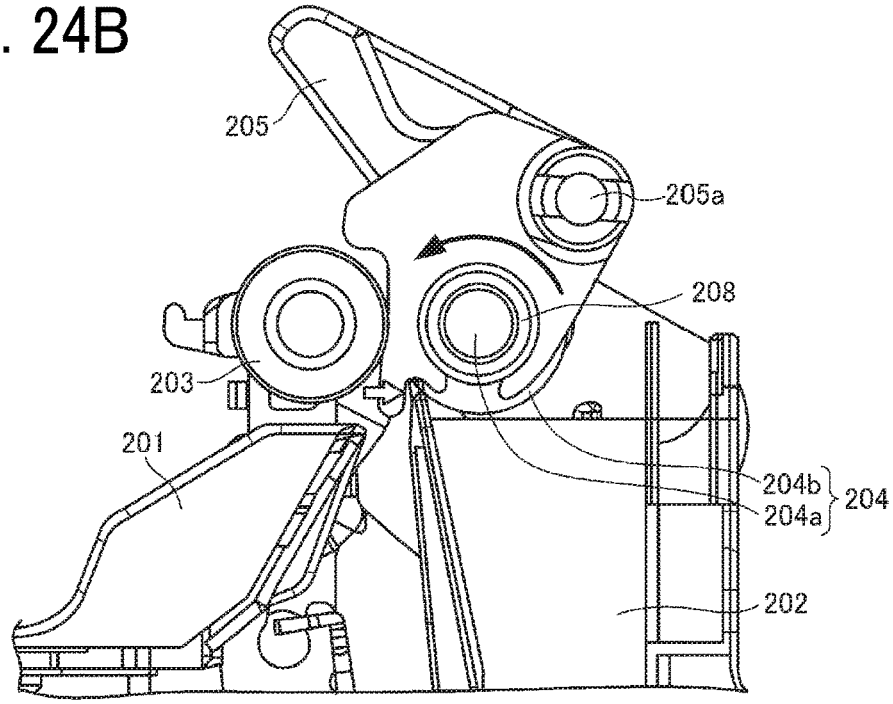
Figure 25A:
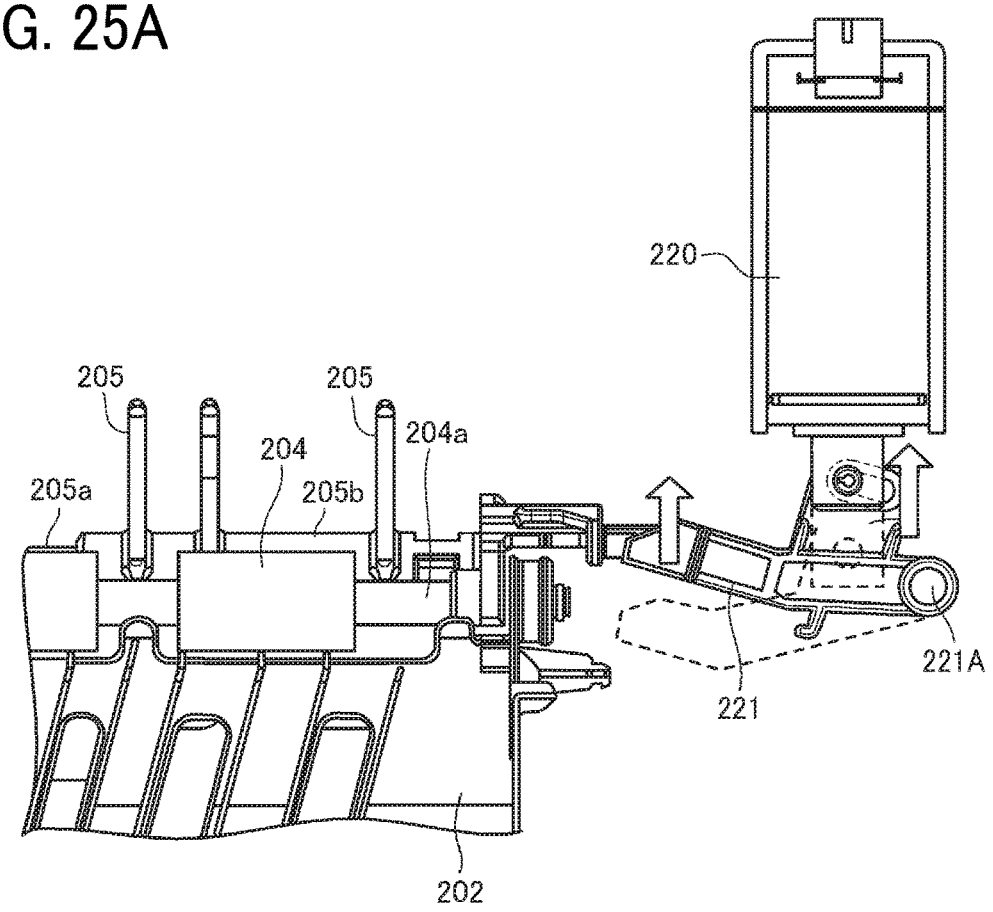
FIGS. 25A and 25B illustrate relative positions of the guide and a guide driving device to move the guide according to Embodiment 2.
Figure 25B:
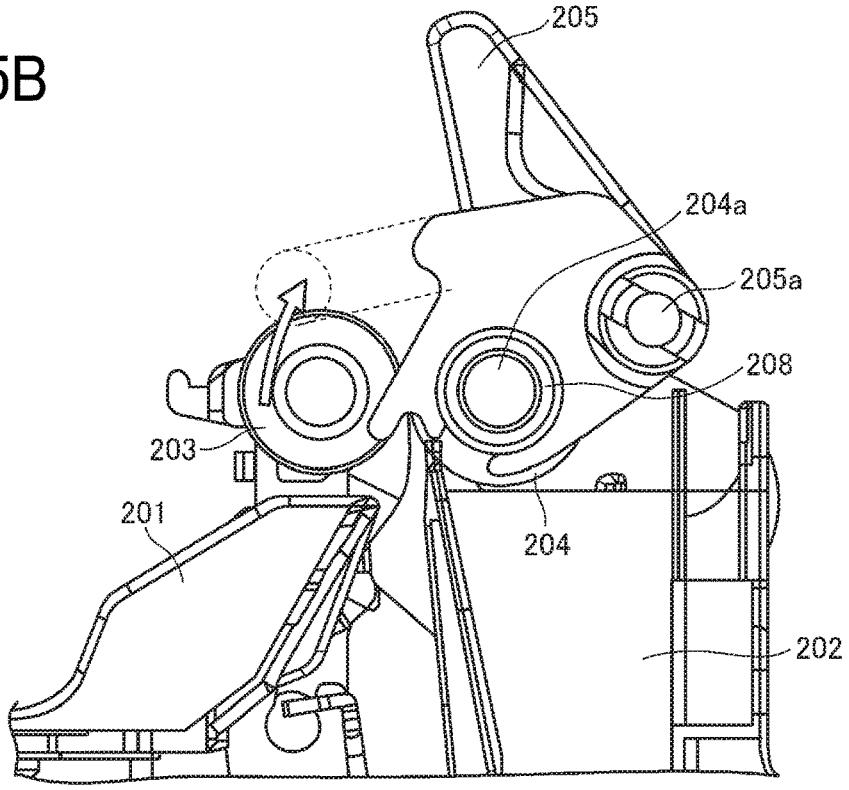

Additionally, as illustrated in FIGS. 24A and 24B, the driving roller 204 includes multiple roller bodies made of rubber and supported by an identical shaft. The multiple roller bodies are spaced so that the ribs of the guide 205 enter between the roller bodies. Therefore, when viewed in the direction indicated by arrow Y in FIG. 24A, the roller bodies of the driving roller 204 overlay with the ribs of the guide 205 as illustrated in FIG. 24B.

As illustrated in FIGS. 24A and 24B, an end of the guide 205 is disposed adjacent to the auxiliary nip AN (see FIGS. 20 and 21) between the driving roller 204 and the driven roller 203 (the conveyance-assist roller pair 230). This structure is advantageous in reliably catching and guiding the sheet P ejected from the conveyance-assist roller pair 230. Further, to attain the curl correction effect and reliable conveyance of the sheet P ejected from the conveyance-assist roller pair 230, the end of the guide 205 is disposed adjacent to the auxiliary nip AN.

Figure 26:
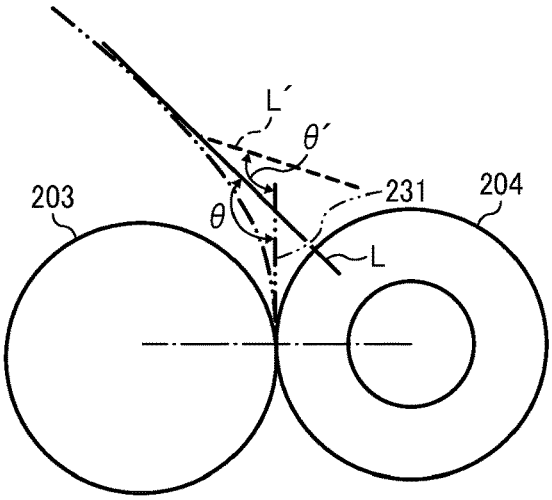
FIG. 26 is a schematic cross-sectional view illustrating relative positions of the guide and a driving roller according to Embodiment 2.

FIG. 26 illustrates comparison between a case in which the end of the guide 205 is disposed overlapping the driving roller 204 of the conveyance-assist roller pair 230 and a case in which the end of the guide 205 is at a distance from the circumference of the driving roller 204 (in particular, the solid rubber layer 204*b* illustrated in FIGS. 20 and 21). In FIG. 26, a solid line L represents the end of the guide 205 when the guide 205 is disposed overlapping the driving roller 204, and a broken line L' represents the end of the guide 205 when the guide 205 is disposed at a distance from the circumference of the driving roller 204.

In the case in which the guide 205 is at a distance from the driving roller 204, the end of the guide 205 is disposed as indicated by the line L' to attain the curl correction similar to that attained by the guide 205 disposed overlapping the driving roller 204. In this case, the sheet P ejected from the conveyance-assist roller pair 230 follow the route 231 perpendicular to the line connecting the centers of the driving roller 204 and the driven roller 203. Accordingly, a contact angle θ' between the leading end of the sheet P and the guide 205 is smaller than the contact angle θ in the configuration in which the guide 205 overlaps the driving roller 204 as in the present embodiment.

If this contact angle decreases, the sheet P is fed with its leading end bent and looped, thereby creating a risk of jamming in the worst case. By contrast, when the guide 205 is disposed so that the sheet P contacts the guide 205 at a greater contact angle (shallowly), the curl correction effect of the guide 205 to bend the sheet can decrease.

Since the end of the guide 205 is disposed adjacent to the auxiliary nip AN in the conveyance-assist roller pair 230 from the above-described reasons, the driving roller 204 includes multiple, divided roller bodies disposed intermittently along the shaft (the metal core 204*a*) to allow the ribs of the guide 205 to enter between the roller bodies.

As illustrated in FIG. 24A, a tension spring 209 biases the guide 205 to the direction to close the sheet conveyance route, and the guide 205 is configured to stop at a position where a stopper of the guide 205 contacts a portion of the pressure-side separator 202. At this time, the guide 205 is at the first position illustrated in FIG. 24B, to change the angle of the conveyance route of the sheet P ejected from the conveyance-assist roller pair 230.

A solenoid 220 (illustrated in FIGS. 25A and 27) and a link 221 (illustrated in FIG. 28) are disposed in the body of the image forming apparatus 1. The link 221 is to move the guide 205 to the second position at which the guide 205 does not change the angle of the sheet conveyance route, and the solenoid 220 drives the link 221.

Figure 27:
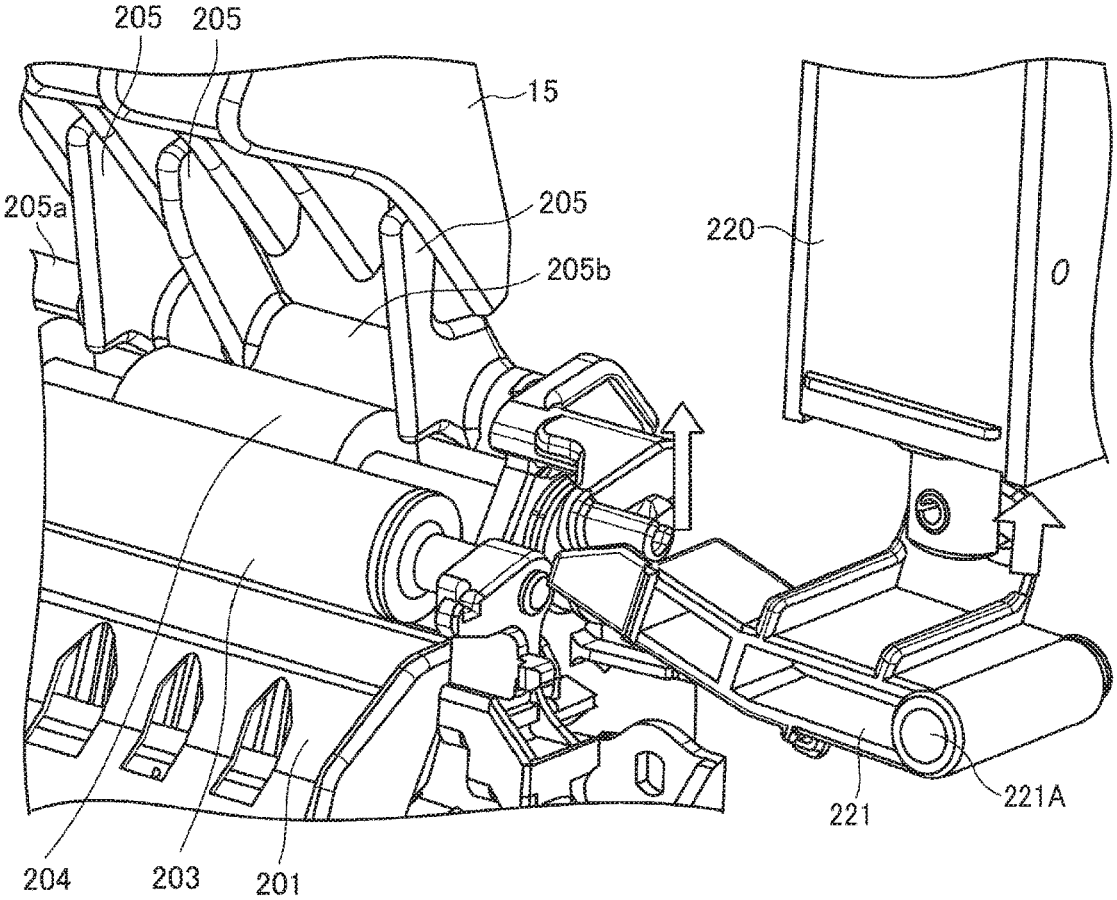
FIG. 27 is a perspective view illustrating relative positions of the guide and the guide driving device.
Figure 28:
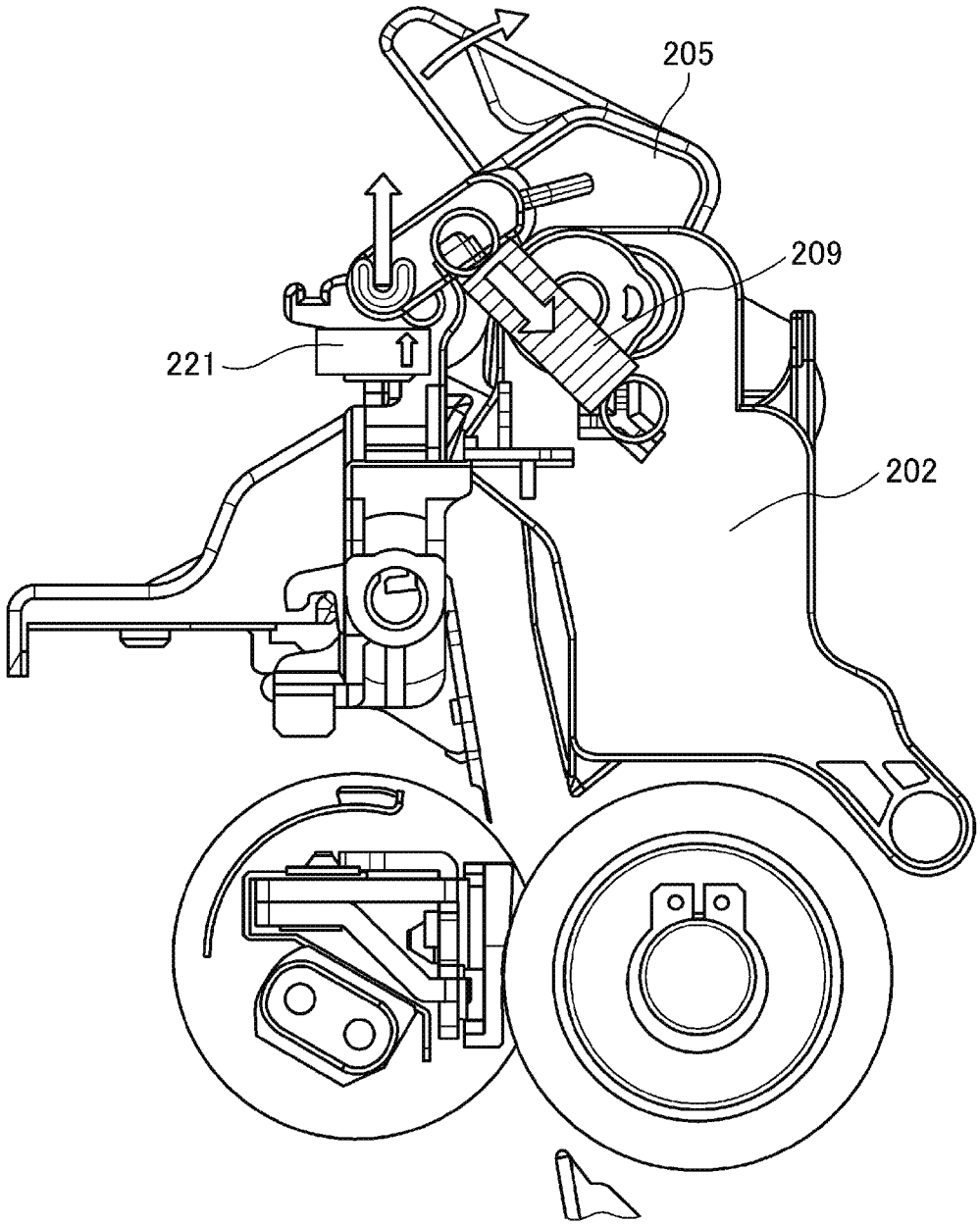
FIG. 28 is a cross-sectional view illustrating relative positions of the guide and the guide driving device.

As illustrated in FIGS. 27 and 28, the link 221 is rotatable around a support point 221A connected to the guide 205. In conjunction with the solenoid 220 being sucked in, an end of the link 221 is lifted and contacts the guide 205. There are multiple guides 205 disposed on respective bosses 205*b* secured to the support 205*a*. As the solenoid 220 is turned on, a sucking-in force is generated. When the solenoid 220 is turned off, the sucking-in force is not generated.

By making the sucking-in force of the solenoid 220 greater than the biasing force of the tension spring 209 applied to the guide 205, the guide 205 is caused to rotate counterclockwise in the drawing to the second position. When the solenoid 220 is sucked in and stopped, the guide 205 is disposed at the second position illustrated in FIG. 25B. The guide face of the guide 205 being at the second position is almost vertical to a horizontal direction (lateral direction) not to change the direction of the conveyance of the sheet P.

In the present embodiment, the first position of the guide 205 relative to the conveyance-assist roller pair 230 is strict, and the first position of the guide 205 can complete inside the unit. The second position thereof is defined by the solenoid 220, which is disposed in the apparatus body, and the link 221. However, this can be reversed.

In another embodiment, a stepping motor is used to drive the guide 205 to change the posture and the position of the guide 205 in multiple steps. For example, to pressing the sheet P against the guide 205 with a relatively weak force to lightly correct curl, the guide 205 is disposed at an intermediate position between the first position and the second position.

As described above, the image forming apparatus 1 according to the present embodiment includes the display 152 to input the type of the sheet P fed to the fixing device 20, the divider 15 to switch the route of the sheet P between the sheet ejection path (1703 or 1706) to eject the sheet P outside the apparatus and the reversing path 17A, the conveyance-assist roller pair 230 disposed downstream from the fixing device 20 and upstream from the divider 15, and the guide 205 disposed immediately downstream from the conveyance-assist roller pair 230 and upstream from the divider 15 to guide the sheet P ejected from the conveyance-assist roller pair 230.

The image forming apparatus 1 according to the present embodiment further includes the solenoid 220 and the link 221 to move the guide 205 between the first position and the second position. The guide 205 being at the first position contacts the sheet P and changes the angle of the conveyance route of the sheet P ejected from the conveyance-assist roller pair 230. The guide 205 being at the second position does not change the angle of the sheet conveyance route. The solenoid 220 and the link 221 are configured to move the guide 205 between the first position and the second position in accordance with the sheet type input via the display 152.

With this configuration, the solenoid 220 and the link 221 together move the guide 205 to the first position or the second position in accordance with the sheet type, thereby turning on and off the decurler in accordance with the sheet type. Thus, the decurler is turned on and off to prevent defective conveyance caused by decurling.

In addition, the solenoid 220 and the link 221 can be configured to move the guide 205 between the first position and the second position in accordance with the ejection roller type. With this configuration, the guide 205 is moved to the second position when the sheet ejection roller 1301 to stiffen the sheet P is used. The guide 205 is moved to the first position when the sheet ejection roller 1800 not to stiffen the sheet P is used. Thus, decurling of the sheet P can be set properly.

In addition, the solenoid 220 and the link 221 can be configured to set the guide 205 at an intermediate position between the first position and the second position. This configuration is advantageous in flexibly setting the decurling strength.

The guide 205 can be rotatably supported coaxially with the shaft (the metal core 204*a*) of the driving roller 204 so that the guide 205 rotates between the first position and the second position. In this configuration, cumulative dimensional tolerance of parts is minimized in the gap between the driving roller 204 and the guide 205. Accordingly, the guide 205 is movable with the gap between the driving roller 204 and the guide 205 kept constant with a high precision.

In addition, the solenoid 220 and the link 221 can be configured to change the position of the guide 205 in accordance with sheet thickness. In this configuration, the guide 205 can be moved to the second position not to contact the sheet P when the sheet P is thick, thereby inhibiting the contract with the guide 205 from marking the sheet P. When the sheet thickness is not greater than the threshold thickness, the guide 205 is moved to the first position to stiffen the sheet P.

The link 221 can be moved by turning on or off the solenoid 220 to move the guide 205.

The conveyance-assist roller pair 230 includes the driving roller 204 that is a rubber roller and the driven roller 203 whose surface has an increased releasing capability to release toner, and the sheet P is fed with the back side thereof (non-image side) facing the driven roller 203 in single-side printing. This configuration is advantageous in inhibiting adhesion and accumulation of toner on the driven roller 203, which contacts the image side of the sheet P.

The above-described Embodiment 2 concerns turning on and off the decurling in accordance with sheet thickness. The cause of curl, however, includes moisture content of the sheet in image fixing in addition to sheet thickness. For example, the sheet P is more likely to curl after the fixing when the moisture content thereof is higher due to a high ambient humidity or the like.

In the image forming apparatus according to Embodiment 3 described below, the decurler is turned on and off in accordance with humidity, thereby inhibiting defective conveyance due to the decurling.

Embodiment 3

An image forming apparatus according to Embodiment 3 is described below.

Elements of the image forming apparatus according to Embodiment 3 identical or similar to those of Embodiments 1 and 2 illustrated in FIGS. 1 and 29 are given identical or similar reference numerals, and descriptions thereof are omitted or simplified.

Figure 32:
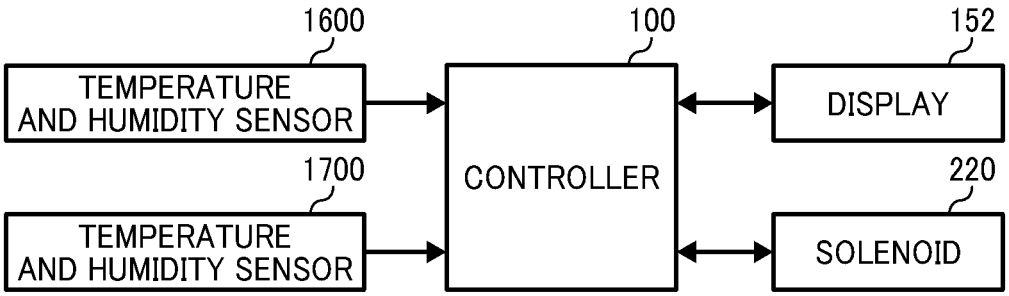
FIG. 32 is a schematic block diagram of control circuitry of the image forming apparatus according to Embodiment 3.

The image forming apparatus 1 includes the image forming section A, the fixing device 20, the display 152, the guide 205, the solenoid 220, a temperature and humidity sensor 1600 (illustrated in FIG. 30), and a controller 100 (see FIG. 32).

Figure 30:
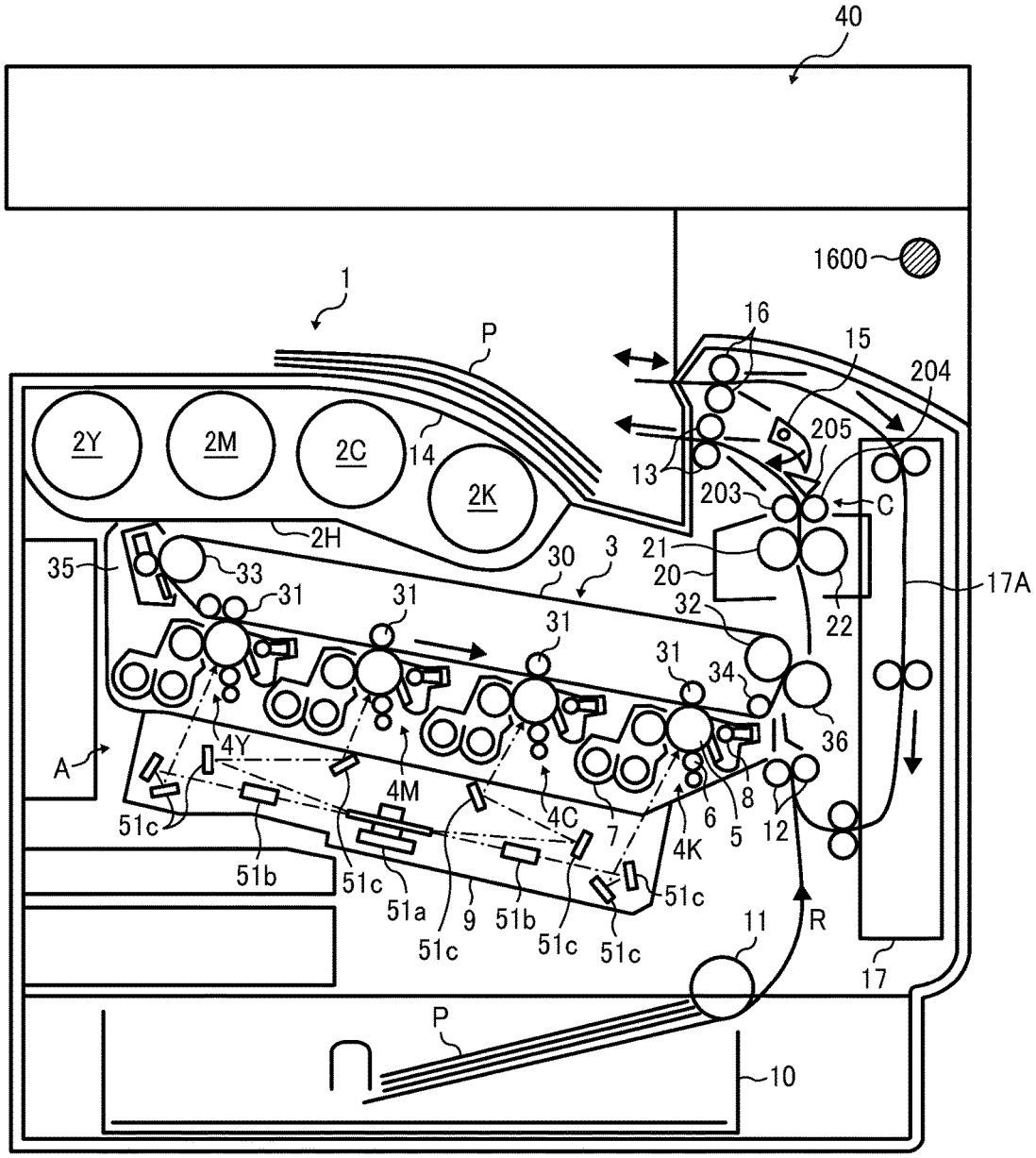
FIG. 30 is a schematic view of an image forming apparatus, illustrating a position of a humidity sensor according Embodiment 3.

As illustrated in FIG. 30, the temperature and humidity sensor 1600 is disposed adjacent to the control panel 150 (see FIG. 2) on the upper face of the image forming apparatus 1. The temperature and humidity sensor 1600, serving as a humidity sensor, detects temperature and humidity (i.e., ambient temperature and ambient humidity) outside the image forming apparatus 1.

Figure 31:
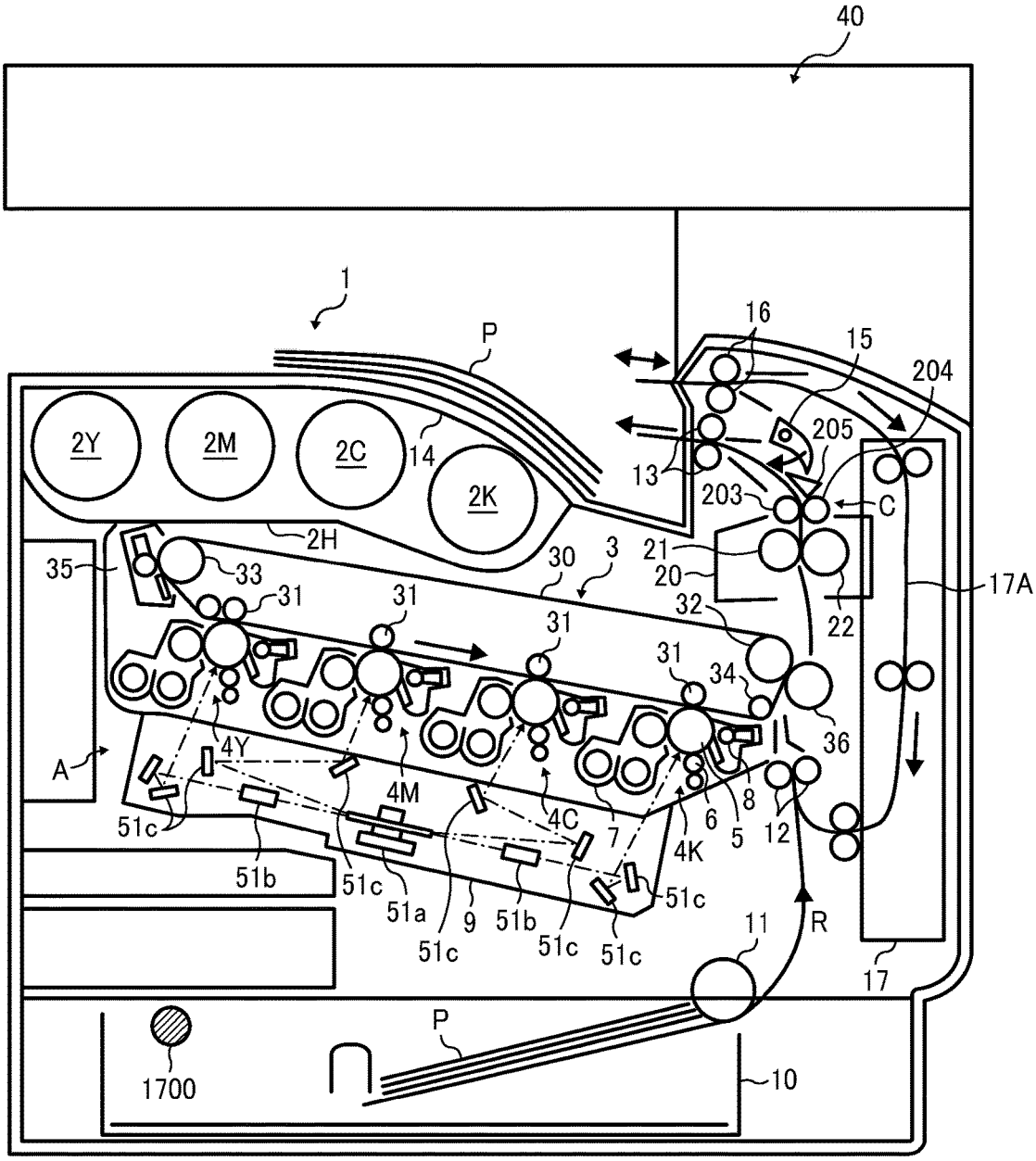
FIG. 31 is a schematic view of an image forming apparatus, illustrating another position of the humidity sensor according Embodiment 3.

Although the temperature and humidity sensor 1600 is disposed in an upper part of the image forming apparatus 1 in the configuration illustrated in FIG. 30, alternatively, a temperature and humidity sensor 1700 is disposed inside the sheet feeding tray 10 in a lower part of the image forming apparatus 1 as illustrated in FIG. 31. The temperature and humidity sensor 1700 detects temperature and humidity inside the image forming apparatus 1 or inside the sheet feeding tray 10.

It is to be noted that the sensor to detect the ambient temperature and the ambient humidity or the temperature and the humidity inside the image forming apparatus 1 is not limited to the temperature and humidity sensors 1600 and 1700.

Next, circuitry of the controller 100 is described.

Referring to FIG. 32, to the controller 100, the temperature and humidity sensors 1600 and 1700, the display 152, and the solenoid 220 are electrically connected. Although both of the temperature and humidity sensors 1600 and 1700 are illustrated in FIG. 32, in one embodiment, the image forming apparatus 1 has only one humidity sensor.

For example, the controller 100 includes a microcomputer that includes a central processing unit (CPU), a random access memory (RAM), a read only memory (ROM), an input and output interface. The controller 100 is configured to control the position of the guide 205 in accordance with at least one of sheet type, the ambient temperature and the ambient humidity, and the temperature and the humidity inside the image forming apparatus 1 in Embodiment 3.

As described above, the temperature and humidity sensor 1600 detects the humidity of outside air, and the temperature and humidity sensor 1700 detects the humidity inside the image forming apparatus 1. Via the display 152, the user can input to the apparatus or set sheet type, sheet thickness, print menu (for example, either single-side printing or duplex printing), and the display 152 displays such information. The solenoid 220, in conjunction with the link 221, is configured to move the guide 205 between the first position and the second position.

Table 1 below presents on-off setting of the decurling in relation to sheet thickness (sheet type) according to a comparative example. Table 2 presents on-off setting of the decurling (e.g., the position of the guide 205) in relation to sheet thickness and humidity in the image forming apparatus 1 according to Embodiment.

TABLE 1

| Sheet type/Sheet thickness | |
|---|---|
| Thin sheet | ON |
| Plain paper | ON |
| Thick sheet | OFF |

TABLE 2

| | Humidity | |
|---|---|---|
| Sheet type/Sheet thickness | Low | High |
| Thin sheet | ON | ON |
| Plain paper | OFF | ON |
| Thick sheet | OFF | OFF |

In Tables 1 and 2, "ON" means that the guide 205 is at the first position illustrated in FIG. 22A to execute decurling, and "OFF" means that the guide 205 is at the second position illustrated in FIG. 22B not to execute decurling.

In the comparative example, the decurling is turned on and off in accordance with sheet type and sheet thickness. When the sheet P is a thin sheet or plain paper, the guide 205 is set at the first position, and the decurling is turned on. When the sheet P is a thick sheet, the guide 205 is set at the second position, and the decurling is turned off. In the present embodiment, sheet thickness is represented by weight per square meter. The thin sheets have a weight not greater than 59 g/cm$^2$, plain paper has a weight greater than 59 g/cm$^2$ and not greater than 160 g/cm$^2$, and the thick sheet have a weight greater than 160 g/cm$^2$.

By contrast, in Embodiment 3, the decurling is turned on and off in accordance with humidity in addition to sheet type and sheet thickness. The humidity mentioned here means the ambient humidity detected by the temperature and humidity sensor 1600; or the humidity inside the image forming apparatus 1 or inside the sheet feeding tray 10 detected by the temperature and humidity sensor 1700.

When the thin sheet is used, the decurling is on regardless of humidity, and the guide 205 is set at the first position. When plain paper is used and the humidity is equal to or lower than a threshold humidity, the sheet P is less likely to curl. Accordingly, the guide 205 is set at the second position. When plain paper is used and the humidity is higher than the threshold humidity, the sheet P is likely to curl. Accordingly, the guide 205 is set at the first position. When the thick sheet is used, the decurling is off regardless of humidity and the guide 205 is set at the first position.

It is to be noted that, the threshold humidity is 50% in Embodiment 3, for example.

Controlling the decurler considering humidity in addition to sheet thickness is advantageous in inhibiting curl of the sheet P in the opposite direction caused by the decurler when humidity is lower, and the sheet P is not curled or the amount of curl is small.

Figure 33:
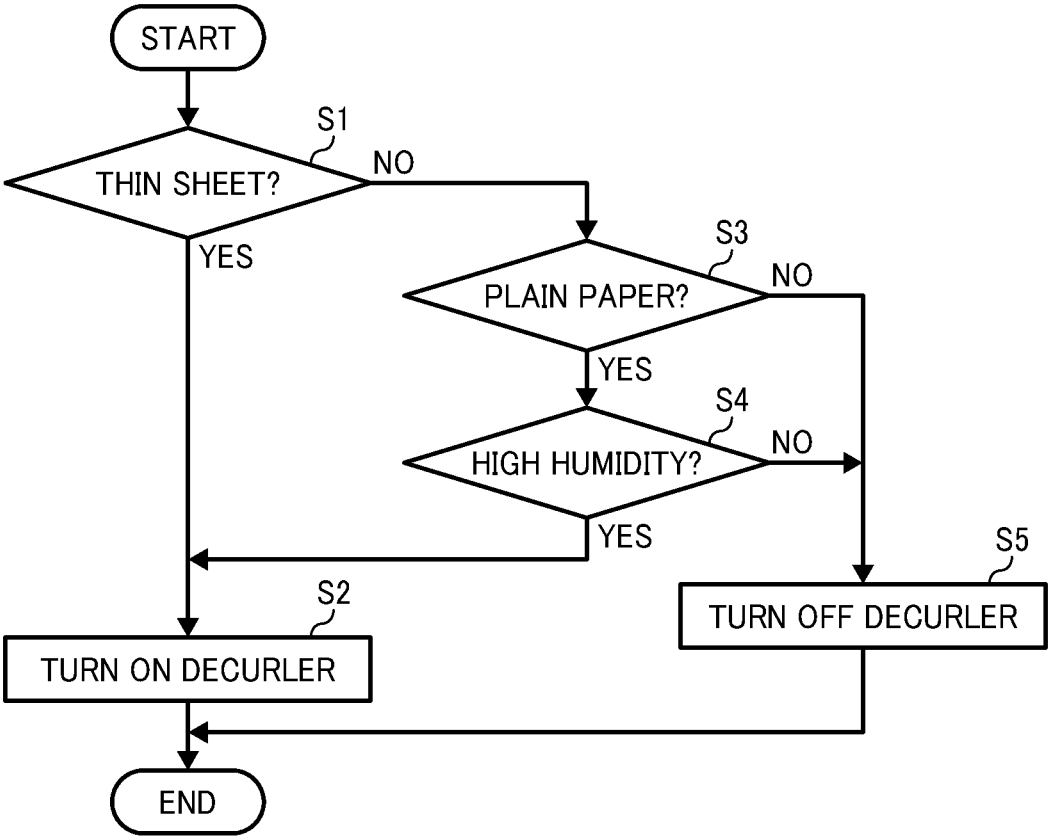
FIG. 33 is a flowchart of on-off control of a decurler of the image forming apparatus according to Embodiment 3.

FIG. 33 is a flowchart of steps of controlling the decurler according to the present embodiment.

At S1, the controller 100 determines whether or not the sheet P is a thin sheet. Determining that the sheet P is a thin sheet (Yes at S1), the controller 100 determines to turn on the decurler at S2. Specifically, the controller 100 causes the solenoid 220 and the link 221, together serving as the guide driving device, to move the guide 205 to the first position. Then, the controller 100 completes determination of turning on and off of the decurler.

When the sheet P is not thin (No at S1), at S3, the controller 100 determines whether or not the sheet P is plain paper. When the sheet P is plain paper (Yes at S3), at S4, the controller 100 determines whether or not the humidity outside or inside the image forming apparatus 1 is high. Specifically, the controller 100 determines whether the humidity is higher than the threshold humidity. Determining that the humidity is high (Yes at S4), the controller 100 determines to turn on the decurler at S2 and causes the solenoid 220 and the link 221 to move the guide 205 to the first position. Then, the controller 100 completes determination of turning on and off of the decurler.

Determining that the sheet P is not plain paper (No at S3), the controller 100 determines to turn off the decurler at S5. Specifically, the controller 100 causes the solenoid 220 and the link 221 to move the guide 205 to the second position. Additionally, when the controller 100 determines that the humidity is low (No at S4), the controller 100 determines to turn off the decurler at S5 and causes the solenoid 220 and the link 221 to move the guide 205 to the second position. Then, the controller 100 completes determination of turning on and off of the decurler.

It is to be noted that the steps in the above-described flowchart may be executed in an order different from that in the flowchart. Further, the aforementioned method may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of the above mentioned embodiments.

As described above, the image forming apparatus 1 according to the present embodiment includes a display 152 to input the type of the sheet P fed to the fixing device 20, the divider 15 to switch the route of the sheet P between the sheet ejection path (1703 or 1706) to eject the sheet P outside the apparatus and the reversing path 17A, the conveyance-assist roller pair 230 disposed downstream from the fixing device 20 and upstream from the divider 15, and the guide 205 disposed immediately downstream from the conveyance-assist roller pair 230 and upstream from the divider 15 to guide the sheet P ejected from the conveyance-assist roller pair 230.

The image forming apparatus 1 according to the present embodiment further includes the solenoid 220 and the link 221 to move the guide 205 between the first position and the second position. The guide 205 being at the first position contacts the sheet P and changes the angle of the conveyance route of the sheet P ejected from the conveyance-assist roller pair 230. The guide 205 being at the second position does not change the angle of the sheet conveyance route. The solenoid 220 and the link 221 are configured to move the guide 205 between the first position and the second position in accordance with the sheet type input via the display 152.

The image forming apparatus 1 further includes temperature and humidity sensor 1600 to detect the ambient humidity, and the solenoid 220 and the link 221 are configured to move the guide 205 between the first position and the second position in accordance with the detected humidity.

With this configuration, the solenoid 220 and the link 221 together move the guide 205 to the first position or the second position in accordance with the humidity in addition to the sheet type, thereby turning on and off the decurler in accordance with the sheet type. This configuration is also advantageous in inhibiting defective conveyance caused when decurling is executed on the sheet that is not curled or the sheet that is lightly curled.

In addition to or instead of the temperature and humidity sensor 1600, the image forming apparatus 1 can includes the temperature and humidity sensor 1700 to detect the humidity inside the image forming apparatus 1.

Numerous additional modifications to the above-described embodiments and variations are possible. It is therefore to be understood that, within the scope of the appended claims, the disclosure of this patent specification may be practiced otherwise than as specifically described herein.

According to the embodiments described above, the sheet stiffening setting is changed in accordance with the conveyance route of the sheet P in the sheet ejection section and thereafter, thereby inhibiting defective conveyance of the sheet while keeping the image forming apparatus compact and facilitating removal and attachment of the sheet ejection roller and the roller holder of the sheet ejection section.

What is claimed is:

1. An image forming apparatus comprising:

an image forming unit configured to form an image on a sheet;

a sheet ejection section including at least one ejection roller pair, the ejection roller pair configured to eject, the sheet bearing the image from the image forming apparatus, the ejection roller pair including a driving-side ejection roller and a driven-side ejection roller; and a roller holder configured to hold the driven-side ejection roller, the roller holding including a hook including a groove having an opening facing towards an outside of the image forming apparatus, the opening defining an insertion portion into which a shaft of the driven-side ejection roller is inserted to attach the roller holder to the sheet ejection section from the outside of the image forming apparatus such that the roller holder is removably attachable to the sheet ejection section from outside of the image forming apparatus.

2. The image forming apparatus according to claim 1, wherein the driven-side ejection roller is removably attachable to the roller holder.

3. The image forming apparatus according to claim 1, wherein the driven-side ejection roller comprises:

a plurality of roller bodies attached to the shaft.

4. The image forming apparatus according to claim 3, wherein the roller holder comprises:

a biasing member configured to bias the driven-side ejection roller toward the driving-side ejection roller.

5. The image forming apparatus according to claim 3, wherein the plurality of roller bodies of the driven-side ejection roller are similar in diameter.

6. The image forming apparatus according to claim 3, wherein the plurality of roller bodies of the driven-side ejection roller are different in diameter.

7. The image forming apparatus according to claim 1, wherein the sheet ejection section is configured to detachably couple to one of a relay unit and a sheet processing apparatus.

8. The image forming apparatus according to claim 7, further comprising:

the relay unit removably coupled to the sheet ejection section; and the sheet processing apparatus removably coupled to the relay unit.

9. The image forming apparatus according to claim 7, wherein the relay unit includes a sheet conveyance path inclined down.

10. The image forming apparatus according to claim 1, further comprising:

an output tray configured to receive the sheet ejected from the sheet ejection section.

11. The image forming apparatus of claim 1, wherein the sheet ejection section includes a first engaging portion and a second engaging portion, the roller holder includes a projection and a lever, the projection and the lever being insertable in the first engaging portion and the second engaging portion, respectively.

12. An image forming apparatus comprising:

an image forming unit configured to form an image on a sheet;

a fixing device configured to fix the image on the sheet;

an input device to input a sheet type of the sheet fed to the fixing device;

a divider configured to switch a conveyance route of the sheet discharged from the fixing device between a sheet ejection path and a reversing path, the sheet ejection path leading to an ejection roller pair and the reversing path feeding the sheet to the image forming unit;

a guide configured to guide the sheet discharged from the fixing device, the guide disposed downstream from the fixing device and upstream from the divider in a direction of conveyance of the sheet;

a guide driving device configured to selectively move the guide between a first position and a second position, the second position being different from the first position; and a controller configured to control the guide driving device to move the guide between the first position and the second position in accordance with the sheet type input by the input device.

13. The image forming apparatus according to claim 12, further comprising:

a conveyance roller pair disposed adjacent to and upstream from the guide in the direction of conveyance of the sheet.

14. The image forming apparatus according to claim 13, wherein the first position crosses a line tangential to a contact portion between the conveyance roller pair, and the second position does not cross the line tangential to the contact portion.

15. The image forming apparatus according to claim 12, wherein the guide is configured to contact the sheet, in response to the guide being at the first position and the guide is configured to be out of contact with the sheet, in response to the guide being at the second position.

16. The image forming apparatus according to claim 12, wherein the guide is configured to not overlap the divider, in response to the guide being at the first position, and the guide is configured to overlap the divider, in response to the guide being at the second position.

17. The image forming apparatus according to claim 16, wherein the guide is configured to contact the sheet before the divider contacts the sheet, in response to the guide being at the first position.

18. The image forming apparatus according to claim 16, wherein the sheet ejection path includes the divider, in response to the guide being at the first position.

19. The image forming apparatus according to claim 13, wherein the guide is rotatably supported coaxially with a shaft of one of the conveyance roller pair.

20. The image forming apparatus according to claim 19, wherein the conveyance roller pair includes a driving roller and a driven roller, and the guide is rotatably supported coaxially with the shaft of the driving roller of the conveyance roller pair.

21. The image forming apparatus according to claim 12, wherein the guide driving device comprises:

a solenoid in a body of the image forming apparatus; and a link coupled to the solenoid, the link configured to operate in conjunction with the solenoid, and wherein the controller is configured to turn on and off the solenoid to cause the link to move the guide.

22. The image forming apparatus according to claim 13, wherein the conveyance roller pair includes:

a driving roller that is a rubber roller; and a driven roller having a surface of increased releasing capability, wherein the sheet is fed with a non-image side of the sheet facing the driving roller in single-side printing.

23. The image forming apparatus according to claim 12, further comprising:

a humidity sensor configured to detect a humidity outside the image forming apparatus, wherein the guide driving device is configured to move the guide between the first position and the second position based on the humidity detected by the humidity sensor.

24. The image forming apparatus according to claim 12, further comprising:

a humidity sensor configured to detect a humidity inside the image forming apparatus, wherein the guide driving device is configured to move the guide between the first position and the second position based on the humidity detected by the humidity sensor.

25. The image forming apparatus according to claim 24, further comprising:

a sheet feeding tray configured to contain the sheet to be fed to the image forming unit, wherein the humidity sensor is inside the sheet feeding tray.

* * * * *